US006308947B1

(12) United States Patent
Kojima et al.

(10) Patent No.: US 6,308,947 B1
(45) Date of Patent: Oct. 30, 2001

(54) SHEET FEEDING APPARATUS

(75) Inventors: Ryuichi Kojima, Toride; Ryukichi Inoue, Abiko; Yoshiyuki Yamazaki, Toride; Yoshihiro Matsuo, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/617,531

(22) Filed: Jul. 14, 2000

(30) Foreign Application Priority Data

Jul. 22, 1999 (JP) ..... 11-207769
Nov. 29, 1999 (JP) ..... 11-337798

(51) Int. Cl.[7] ..... B65H 3/52
(52) U.S. Cl. ..... 271/124; 271/167
(58) Field of Search ..... 271/124, 121, 271/167, 117, 162

(56) References Cited

U.S. PATENT DOCUMENTS 5,253,854 10/1993 Tanoue et al. ..... 271/10
5,292,116 3/1994 Inoue et al. ..... 271/157
5,651,540 7/1997 Watanabe et al. ..... 271/10.12
5,895,039 * 4/1999 Kato et al. ..... 271/124
5,907,745 5/1999 Azuma et al. ..... 399/92
5,927,702 7/1999 Ishii et al. ..... 271/9.09
6,055,407 4/2000 Inoue et al. ..... 399/381
6,071,867 6/2000 Tsurumi et al. ..... 271/114
6,126,161 * 10/2000 Kato ..... 271/124 X
6,158,733 * 12/2000 Muraki ..... 271/124 X

* cited by examiner

*Primary Examiner*—David H. Bollinger
(74) *Attorney, Agent, or Firm*—Fitzpatrick, Cella, Harper & Scinto

(57) ABSTRACT

The present invention provides a sheet feeding apparatus which has a sheet stacking surface for supporting sheets, sheet feeding device for feeding out the sheets supported on the sheet stacking surface, a movable separation inclined surface against which leading ends of the sheets supported on the sheet stacking surface abut and which is provided rotatably between a first position and a second position different in an inclination angle of the movable separation inclined surface with respect to the sheet stacking surface, and operation device for switching the movable separation inclined surface between the first position and the second position.

20 Claims, 17 Drawing Sheets

SHEET FEEDING APPARATUS

BACKGROUND OF THE INVENTION

1. Field of the Invention

The present invention relates to a sheet feeding apparatus for feeding a sheet to an image forming apparatus and the like.

2. Related Background Art

Among conventional sheet feeding apparatuses used in image forming apparatuses such as printers, copying machines, facsimiles and the like, there is a sheet feeding apparatus of inclined surface separation type for effecting sheet separation by using an inclined surface. In the sheet feeding apparatus of inclined surface separation type, an inclined surface is provided in front of stacked sheets, and, when a sheet feeding roller abuts against an uppermost sheet in the sheet stack and feeds the sheets, the fed sheets abut against the inclined surface to be separated one by one.

An example of such a sheet feeding apparatus of inclined surface separation type will be explained with reference to FIGS. 14 to 16.

In FIG. 14, the sheet feeding apparatus 50 for successively feeding the stacked sheets comprises a sheet feeding tray portion 51 for stacking the sheets to be fed, a sheet feeding portion 52 for separating and feeding the stacked sheets one by one, and a conveying portion 53 for conveying the fed sheet.

The sheet feeding portion 52 includes a sheet feeding roller 54 rotated integrally with a gear (not shown), an idler gear 55 meshed with the gear (not shown) of the sheet feeding roller 54, an idler gear 56 meshed with the idler gear 55, a drive gear 57 meshed with the idler gear 56, a drive shaft 58 attached to be rotated together with the drive gear 57, and a sheet feeding roller holder 59 rotatably attached to the drive shaft 58 and adapted to rotatably support the sheet feeding roller 54, idler gears 55, 56 and drive gear 57.

The conveying portion 53 includes a lower guide 60 for guiding a lower surface of the sheet fed from the sheet feeding portion 52, an upper guide 61 for guiding an upper surface of the fed sheet, a conveying roller 62 for conveying the sheet guided by the lower and upper guides 60, 61 to an image forming portion, a rotatable conveying sub-roller 63 opposed to the conveying roller 62, a sub-roller holder 64 rotatably supported by the upper guide 61 and adapted to rotatably support the conveying sub-roller 63, and a conveying spring 65 for biasing the sub-roller holder 64 to urge the conveying sub-roller 63 against the conveying roller 62.

The sheet feeding tray portion 51 includes a sheet feeding tray 66 for supporting the sheets S in an inclined condition, and a separation inclined surface 67 contiguous to the sheet feeding tray 66 and against which leading ends of the stacked sheets abut and are held and which is adapted to separate the sheets one by one.

In the sheet feeding apparatus 50 having the above-mentioned arrangement, a sheet feeding operation is effected as follows.

The drive shaft 58 receives a driving force from a controllable driving mechanism (not shown), and start and stop of the sheet feeding operation are controlled. When the sheet feeding operation is started, the drive shaft 58 is rotated by the driving mechanism (not shown). Such rotation is transmitted to the sheet feeding roller 54 through the drive gear 57 and idler gears 56, 55, thereby rotating the sheet feeding roller 54.

A sheet feeding roller arm 59 for holding the sheet feeding roller 54 for rotation around the drive shaft 58 is subjected to a force by biasing means (not shown) or by its own weight to be rotated in an anti-clockwise direction, and, by this force, the sheet feeding roller 54 is slightly contacted with an uppermost sheet in the sheet stack rested on the sheet feeding tray 66 of the sheet feeding tray portion 51.

Accordingly, when the rotation of the sheet feeding roller 54 is started, a feeding force F due to a friction force of the sheet feeding roller 54 acts on the sheet stack S. The sheet stack is subjected to a reaction force F from the separation inclined surface 67, and, by this reaction force F, the sheet stack is bent along the separation inclined surface 67, and the sheet stack is advanced in the bent condition while abutting the leading end of the sheet stack against the separation inclined surface 67. In this case, if the plural sheets are fed out, only the uppermost sheet is separated and fed by the separation inclined surface 67.

The separated sheet is directed by the upper and lower guides 61, 60 and enters into a nip defined between the conveying roller 62 and the conveying sub-roller 63 biased toward the conveying roller 62 by the conveying spring 65 and is further conveyed by the conveying roller 62 toward a downstream direction.

In this way, in this sheet feeding apparatus of inclined surface separation type, the sheets can be separated and fed one by one by the separation inclined surface 67.

In such a sheet feeding apparatus of inclined surface separation type, the sheet stacking surface for stacking the sheets is fixed. Since an arrangement which is generally used and in which an intermediate plate for stacking sheets is rockably provided and is biased by a spring is not required, and, since additional separation claws or separation pads are not required because only the inclined surface may be provided as separation means, the construction becomes simpler and cheaper. Further, since thick sheets which could not separated by the separation claws can be separated, the kind of sheets to be separated is increased.

Incidentally, in the above-mentioned conventional technique, while an example that the inclined surface separation system is applied to the sheet feeding apparatus having the inclined sheet feeding tray was explained, the inclined surface separation system may be applied to a sheet feeding apparatus in which sheets are supported and fed out in a horizontal condition. Further, the separation inclined surface may be provided on a so-called sheet feeding cassette for stacking sheets detachably attachable to a main body of the apparatus.

An example that the separation inclined surface is provided on the sheet feeding cassette will be explained with reference to FIG. 17.

A sheet feeding cassette 71 detachably attachable to a main body 70 of the apparatus is mounted to the main body 70 of the apparatus from a direction shown by the arrow. The sheet feeding cassette 71 includes a resting surface 72 on which sheets S are stacked, a separation inclined surface 73 for separating the sheets, and a trailing end regulating plate 74 for regulating trailing ends of the sheets S stacked on the resting surface 72. The separation inclined surface 73 is located at a front part of the sheet feeding cassette 71 in a mounting direction.

The main body 70 of the apparatus includes a sheet feeding roller 75 for feeding out the sheets S contained in the sheet feeding cassette 71, and the sheet feeding roller 75 is supported by a sheet feeding roller holder 77 rotatable around a rotary fulcrum 76.

When the sheet feeding cassette 71 containing the sheets is mounted to the main body 70 of the apparatus and the sheet feeding roller 75 is rotated while contacting with the upper surface of the sheet stack, the sheets are fed, and the fed sheets abut against the separation inclined surface 73 and are separated one by one.

However, the above-mentioned conventional sheet feeding apparatus 50 arose the following problems.

When the sheet bundle (stack) is inserted onto the sheet feeding tray portion 51 forcibly for sheet replenishment, since the separation inclined surface 67 is inclined with respect to the sheet inserting direction, if the sheet stack abuts against the separation inclined surface 67 strongly, the leading end of the sheet stack will be deformed as shown in FIG. 15. Such deformation may cause double-feeding or multi-feeding when the sheets are fed out by the sheet feeding roller 54. Further, if a large number of sheets are inserted onto the sheet feeding tray 51 at once, due to deformation of some of sheets, the sheets are not stopped by the separation inclined surface 67 but are further slipped, with the result that the inserted sheets cannot be stacked at a predetermined position, while may result in the double-feeding.

Further, when the sheets are inserted into the sheet feeding tray portion 51 for sheet replenishment, since the sheet feeding roller 54 remains in a lowered condition as shown in FIG. 16, the leading end of the sheet stack abuts against the sheet feeding roller 54. In this condition, the sheets are hard to be inserted into the sheet feeding tray portion 51 and the sheet feeding roller 54 may be damaged by the leading end of the sheet stack. Further, when the sheets stacked on the sheet feeding tray portion 51 are removed for changing sheet size or sheet material, if the sheet feeding roller 54 is in the lowered condition to abut against the sheet stack, the sheets are hard to be removed from the sheet feeding tray portion 51 or cannot be removed, depending upon arrangement.

Further, in the sheet feeding apparatus as shown in FIG. 17 in which the separation inclined surface 73 is provided on the sheet feeding cassette 71, the following problem arose.

When the sheet feeding cassette 71 is dismounted from the main body 70 of the apparatus for sheet replenishment and then the sheet feeding cassette 71 is inserted into the main body 70 of the apparatus again after the sheet replenishment, if the cassette is inserted forcibly, the stacked sheets S strongly abut against the separation inclined surface 73 due to inertia. In this case, since the separation inclined surface 73 is inclined with respect to the inserting direction of the sheet feeding cassette 71, the leading end of the sheet stack S is deformed as shown in FIG. 17. Such deformation may cause the double-feeding.

SUMMARY OF THE INVENTION

The present invention aims to eliminate the above-mentioned conventional drawbacks, and an object of the present invention is to provide a sheet feeding apparatus of inclined surface separation type, in which leading ends of sheets are not deformed when the sheets are replenished, and, thus, double feeding due to deformation can be prevented and in which a larger number of sheets can be inserted.

To achieve the above object, the present invention provides a sheet feeding apparatus comprising a sheet stacking surface for supporting sheets, sheet feeding means for feeding out the sheets supported on the sheet stacking surface, a movable separation inclined surface against which leading ends of the sheets supported on the sheet stacking surface abut and which is provided rotatably between a first position and a second position different in an inclination angle of the separation inclined surface with respect to the sheet stacking surface, and operation means for switching the movable separation inclined surface between the first position and the second position.

DETAILED DESCRIPTION OF THE PREFERRED EMBODIMENTS

Figure 2:
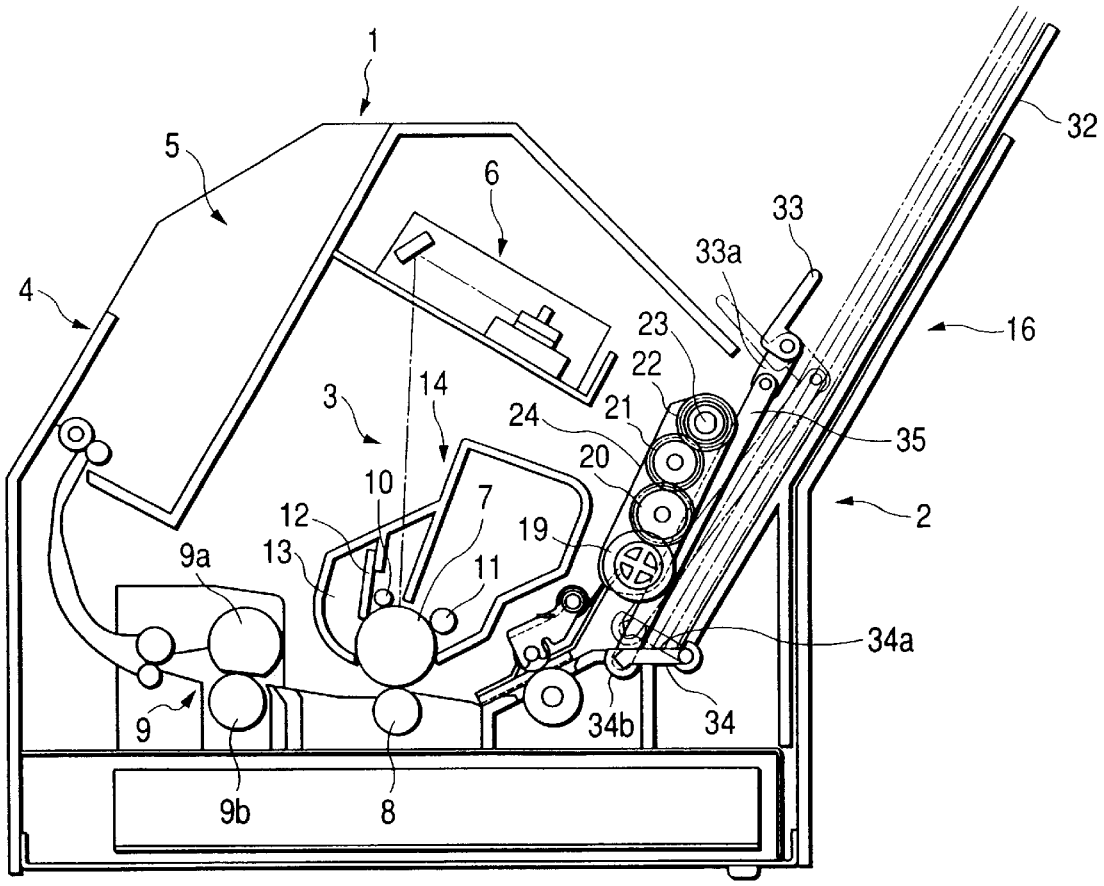
FIG. 2 is a sectional view of an image forming apparatus having the sheet feeding apparatus according to the first embodiment.

The present invention will now be explained in connection with embodiments thereof with reference to the accompanying drawings. First of all, an entire construction of an image forming apparatus 1 having a sheet feeding apparatus according to the present invention will be explained with reference to FIG. 2. Incidentally, the sheet feeding apparatus is of type in which sheets are supported and fed out in an oblique condition.

The image forming apparatus 1 includes a sheet feeding apparatus 2 for containing and feeding sheets S on which images are to be formed, an image forming portion 3 for forming the image on the sheet fed from the sheet feeding apparatus 2, discharge means 4 for discharging the sheet on which the image was formed in the image forming portion 3, and sheet stacking means 5 for stacking the discharged sheets.

In the image forming portion 3, a light image corresponding to target image information from an optical system 6 is illuminated onto a photosensitive drum 7 as an image bearing member by exposing means (slit focusing projection means for an original image or laser scan exposing means; not shown), thereby forming a latent image which is in turn visualized by developer (referred to as "toner" hereinafter) as a toner image. In synchronous with formation of the toner image, the sheet is fed from the sheet feeding apparatus 2, and the toner image formed on the photosensitive drum 7 is transferred onto the sheet by a transfer roller 8 as transferring means. The sheet to which the toner image was transferred is sent to fixing means 9 comprised of a fixing rotary member 9*a* including a heater therein and a driving roller 9*b* urged against the fixing rotary member 9*a*, where the toner image is fixed to the sheet.

The image forming portion 3 includes a process cartridge 14 comprising the rotatable photosensitive drum 7 having a photosensitive layer, a charge roller 10 as charging means for uniformly charging the surface of the photosensitive drum 7 by applying voltage, developing means 11 for developing the surface of the photosensitive drum 7 on which the latent image was formed by the light image from the optical system 6, cleaning means 12 for removing residual toner remaining on the surface of the photosensitive drum 7 after the toner image was transferred to the sheet by the transfer roller 8, and a waste toner container 13 for collecting the removed toner.

Next, a sheet feeding apparatus according to a first embodiment of the present invention will be explained with reference to FIG. 1.

The sheet feeding apparatus 2 comprises a sheet feeding tray portion 16 for stacking sheets S to be fed, a sheet feeding portion 17 for feeding the sheet, and a conveying portion 18 for conveying the fed sheet. The sheet feeding tray portion 16 is arranged in an inclined condition so that the sheets are supported in the inclined condition.

The sheet feeding portion 17 includes a sheet feeding roller 19 rotated integrally with a gear (not shown), an idler gear 20 meshed with the gear (not shown) of the sheet feeding roller 19, an idler gear 21 meshed with the idler gear 20, a drive gear 22 meshed with the idler gear 21, a drive shaft 23 rotated integrally with the drive gear 22, and a sheet feeding roller holder 24 adapted to rotatably support the sheet feeding roller 19, idler gears 20, 21 and drive gear 22 and rotatably attached to the drive shaft 23.

The conveying portion 18 includes a lower guide 26 for guiding a lower surface of the sheet fed from the sheet feeding tray portion 16 by the sheet feeding portion 17, an upper guide 27 for guiding an upper surface of the fed sheet, a conveying roller 28 for conveying the fed sheet to the image forming portion 3, a rotatable conveying sub-roller 29 opposed to the conveying roller 28, a sub-roller holder 30 rotatably supported by the upper guide 27 and adapted to rotatably support the conveying sub-roller 29, and a conveying spring 31 for biasing the sub-roller holder 30 to urge the conveying sub-roller 29 against the conveying roller 28.

The sheet feeding tray portion 16 includes a sheet feeding tray 32 for supporting the sheets, a movable inclined surface member 34 rotatably attached to a lower end of the sheet feeding tray 32, and a movable inclined surface operation lever 33 connected to the movable inclined surface member 34 via an arm 35. A movable separation inclined surface 34*a* for separating the sheets is formed on a surface of the movable inclined surface member 34 facing the sheet S.

The movable inclined surface operation lever 33 is rotatably supported with respect to the sheet feeding tray 32 and has a link arm portion 33*a* for rotatably supporting the arm 35. Further, the movable inclined surface member 34 has a link portion 34*b* for rotatably supporting the arm 35, and the arm 35 connects the link arm portion 33*a* of the movable inclined surface operation lever 33 to the link portion 34*b* of the movable inclined surface member 34.

Figure 1:
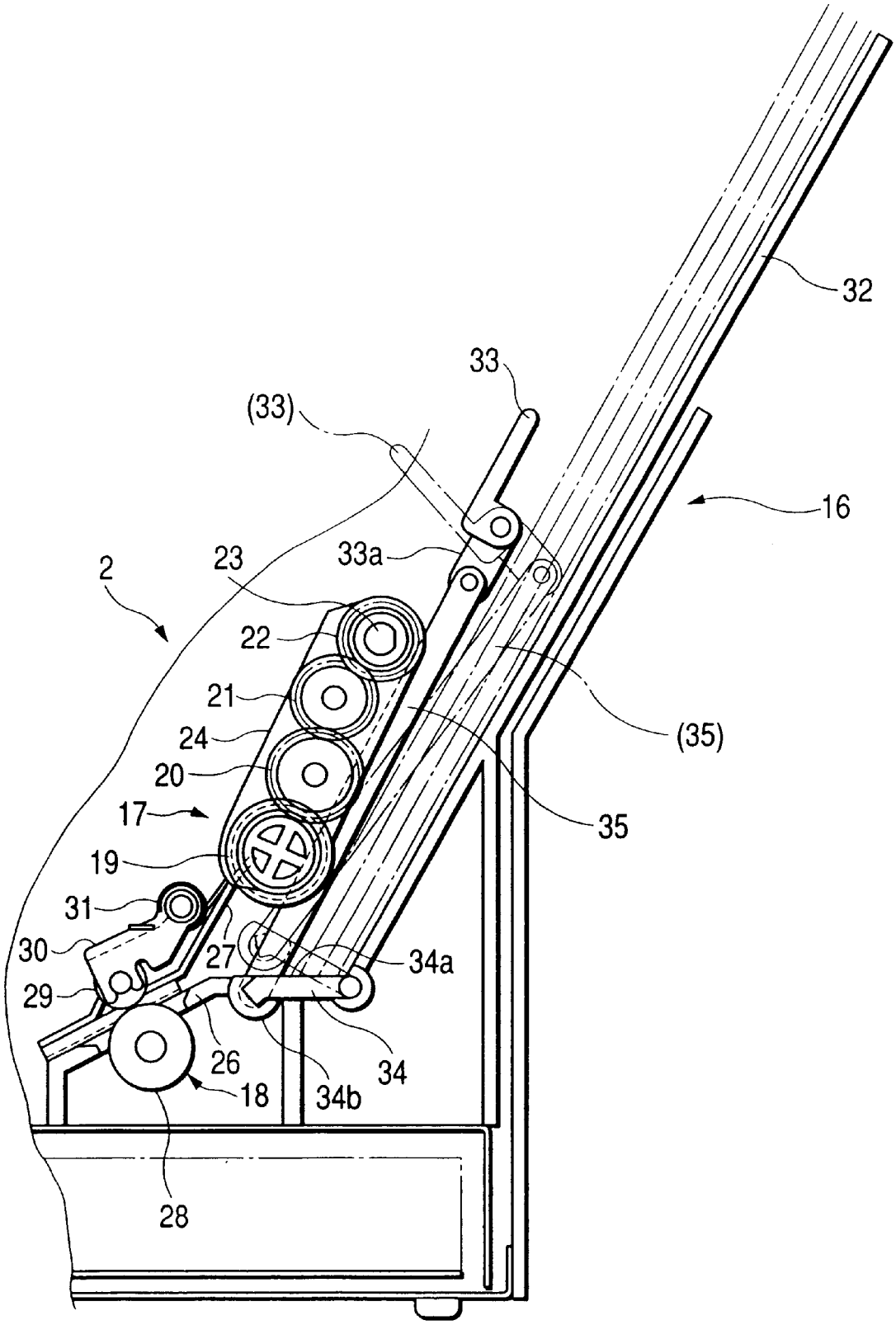
FIG. 1 is a sectional view of a sheet feeding apparatus according to a first embodiment of the present invention.

With this arrangement, when the movable inclined surface operation lever 33 is rotated to a first operation position shown by the chain line in FIG. 1, the link arm portion 33*a* is rotated around a rotary shaft, thereby shifting the arm 35. By the shifting movement of the arm 35, the movable inclined surface member 34 is rotated to a first position where the movable separation inclined surface 34*a* becomes substantially perpendicular to a sheet stacking surface of the sheet feeding tray 32.

On the other hand, when the movable inclined surface operation lever 33 is rotated to a second operation position shown by the solid line in FIG. 1, the link arm portion 33*a* is rotated around a rotary shaft, thereby shifting the arm 35. By the shifting movement of the arm 35, the movable inclined surface member 34 is rotated to a second position where an angle between the movable separation inclined surface 34*a* and the sheet stacking surface of the sheet feeding tray 32 becomes greater than that in the first position. When the movable inclined surface member 34 is in the second position, the movable separation inclined surface 34*a* performs a separation inclined surface function for separating the sheets.

Incidentally, the movable inclined surface operation lever 33 can be locked at the first and second position by rocking means (not shown), respectively.

With the above-mentioned arrangement, the following effects can be achieved.

In a case where the sheets S are inserted onto the sheet feeding tray 32, when the movable inclined surface operation lever 33 is rotated to the first operation position, the movable inclined surface member 34 is shifted to the first position where the movable separation inclined surface 34*a* becomes substantially perpendicular to the sheet stacking surface of the sheet feeding tray 32. As a result, even if the operator inserts the sheet stack S onto the sheet feeding tray 32 forcibly, since the movable separation inclined surface 34*a* is positioned substantially perpendicular to an inserting direction, when the sheet stack abuts against the movable separation inclined surface 34*a*, the sheet stack is not slipped and thus is not deformed, thereby stacking the sheets properly.

Thereafter, when the movable inclined surface operation lever 33 is rotated to the second operation position, in synchronous with this rotation, the movable inclined surface member 34 is rotated to the second position. Since this operation is performed slowly, the end of the sheet stack is not deformed by this operation. When the movable inclined surface member 34 is in the second position, since the angle between the movable separation inclined surface 34*a* and the sheet stacking surface of the sheet feeding tray 32 becomes an obtuse angle, the sheets can surely be separated and fed by the movable separation inclined surface 34*a*.

In this way, even if the operator inserts the sheet stack S onto the sheet feeding tray 32 forcibly, since the sheet stack S abuts against the movable separation inclined surface 34*a* substantially perpendicular to the inserting direction, the end of the sheet stack S is not deformed. As a result, in the sheet feeding operation, double feeding due to deformation of the ends of the sheets does not occur.

According to the illustrated embodiment, when the sheets S are inserted onto the sheet feeding tray 32, since the ends of the sheets can surely be prevented from being deformed and the sheets are prevented from being excessively advanced along the movable separation inclined surface 34*a*, the double feeding is suppressed and a sheet feeding apparatus capable of stacking a large number of sheets can be realized.

Incidentally, in the first embodiment, while an example that the lever is used for shifting the movable inclined surface member 34 between the first and second positions was explained, the present invention is not limited to such an example, but any switchable arrangement such as a toggle switch may be used.

Figure 3:
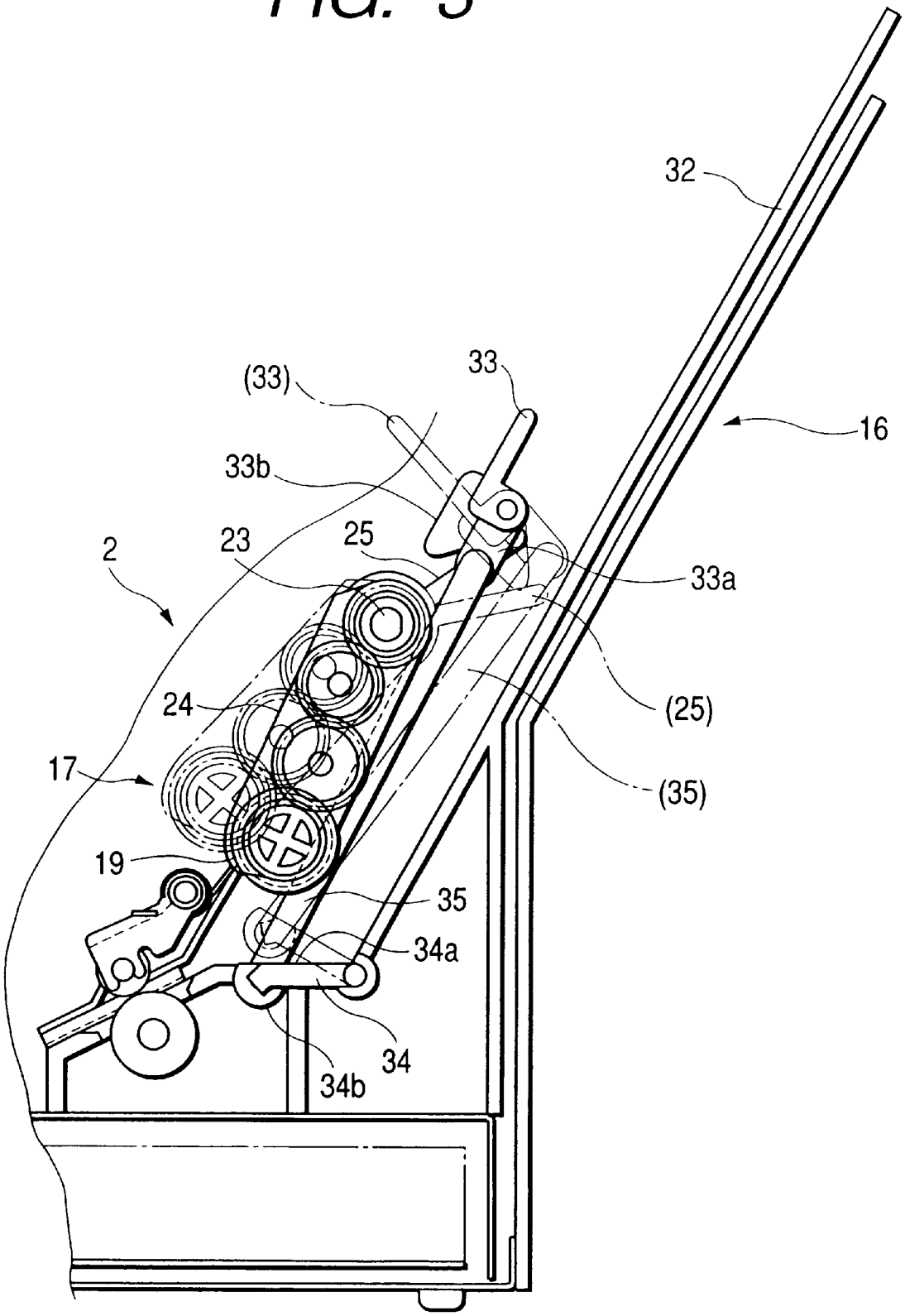
FIG. 3 is a sectional view of a sheet feeding apparatus according to a second embodiment of the present invention.

Next, a second embodiment of the present invention will be explained with reference to FIG. 3. Incidentally, since a construction of an image forming apparatus 1 is the same as that in the first embodiment, explanation thereof will be omitted, and only a sheet feeding apparatus will be fully described. Incidentally, the same elements as those in the first embodiment are designated by the same reference numerals, and detailed explanation thereof will be omitted.

A sheet feeding apparatus 2 according to the second embodiment includes a sheet feeding tray portion 16 for stacking sheets S to be fed, and a sheet feeding portion 17 for successively feeding the sheets S stacked on the sheet feeding tray portion 16. The sheet feeding portion is similar to that in the first embodiment, except that a sheet feeding arm 25 protruded outwardly from the drive shaft 23 is provided on the sheet feeding roller holder 24.

Similar to the first embodiment, the sheet feeding tray portion 16 includes a sheet feeding tray 32 for stacking the sheets, a movable inclined surface member 34 rotatably attached to the sheet feeding tray 32, a link arm portion 33*a* provided on a movable inclined surface operation lever 33, a link portion 34*b* provided on the movable inclined surface member 34, and an arm 35 for connecting the link arm portion 33*a* of the movable inclined surface operation lever 33 to the link portion 34*b* of the movable inclined surface member 34. Different from the first embodiment, a protruded portion 33*a* capable of engaging with the sheet feeding arm 25 is provided on the movable inclined surface operation lever 33.

That is to say, the second embodiment is characterized by the sheet feeding arm 25 attached to be rotated integrally with the sheet feeding roller holder 24, and the protruded portion 33*b* provided on the movable inclined surface operation lever 33. By rotating the movable inclined surface operation lever 33, the protruded portion 33*b* urges the sheet feeding arm 25, thereby rotating the sheet feeding roller holder 24. Due to this rotation, the sheet feeding roller 19 is shifted above an upper surface of the sheet stack on the sheet feeding tray 32 in a maximum stacking condition.

With the arrangement as mentioned above, the same advantage as the first embodiment can be obtained, and further the following inherent effect can be achieved.

When the movable inclined surface operation lever 33 is shifted to the first operation position, the protruded portion 33*b* of the movable inclined surface operation lever 33 is engaged by the sheet feeding arm 25 thereby to lower the latter. When the sheet feeding arm 25 is lowered, the sheet feeding roller holder 24 is rotated to separate the sheet feeding roller 19 from the sheet stacking surface. When the movable inclined surface operation lever 33 is locked at the first operation position, the sheet feeding roller 19 is shifted up to a position sufficiently spaced apart from the upper surface of the sheet stack in the maximum stacking condition.

When the movable inclined surface operation lever 33 is shifted to the first operation position in this way, the movable separation inclined surface 34*a* of the movable inclined surface member 34 becomes substantially perpendicular to the sheet stacking surface of the sheet feeding tray 32, the sheet feeding roller 19 is shifted to the position spaced apart from the upper surface of the sheet stack rested on the sheet feeding tray 32. Accordingly, in this condition when the sheets are inserted onto the sheet feeding tray 32 or removed from the sheet feeding tray, since the sheet feeding roller 19 is spaced apart from the sheet stack, such inserting or removing operation can easily be performed, and the sheet feeding roller 19 is not damaged by the sheet stack.

Further, when the movable inclined surface operation lever 33 is shifted to the second operation position, the movable separation inclined surface 34*a* of the movable inclined surface member 34 is rotated to the inclination angle capable of separating the sheets, and the protruded portion 33*b* of the movable inclined surface operation lever 33 releases the sheet feeding arm 25, with the result that the sheet feeding roller 19 abuts against the upper surface of the sheet stack S.

In this way, according to the second embodiment, a sheet feeding apparatus in which the insertion and removal of the sheet stack with respect to the sheet feeding tray 32 can be facilitated and the sheet feeding roller is not damaged can be provided.

Figure 4:
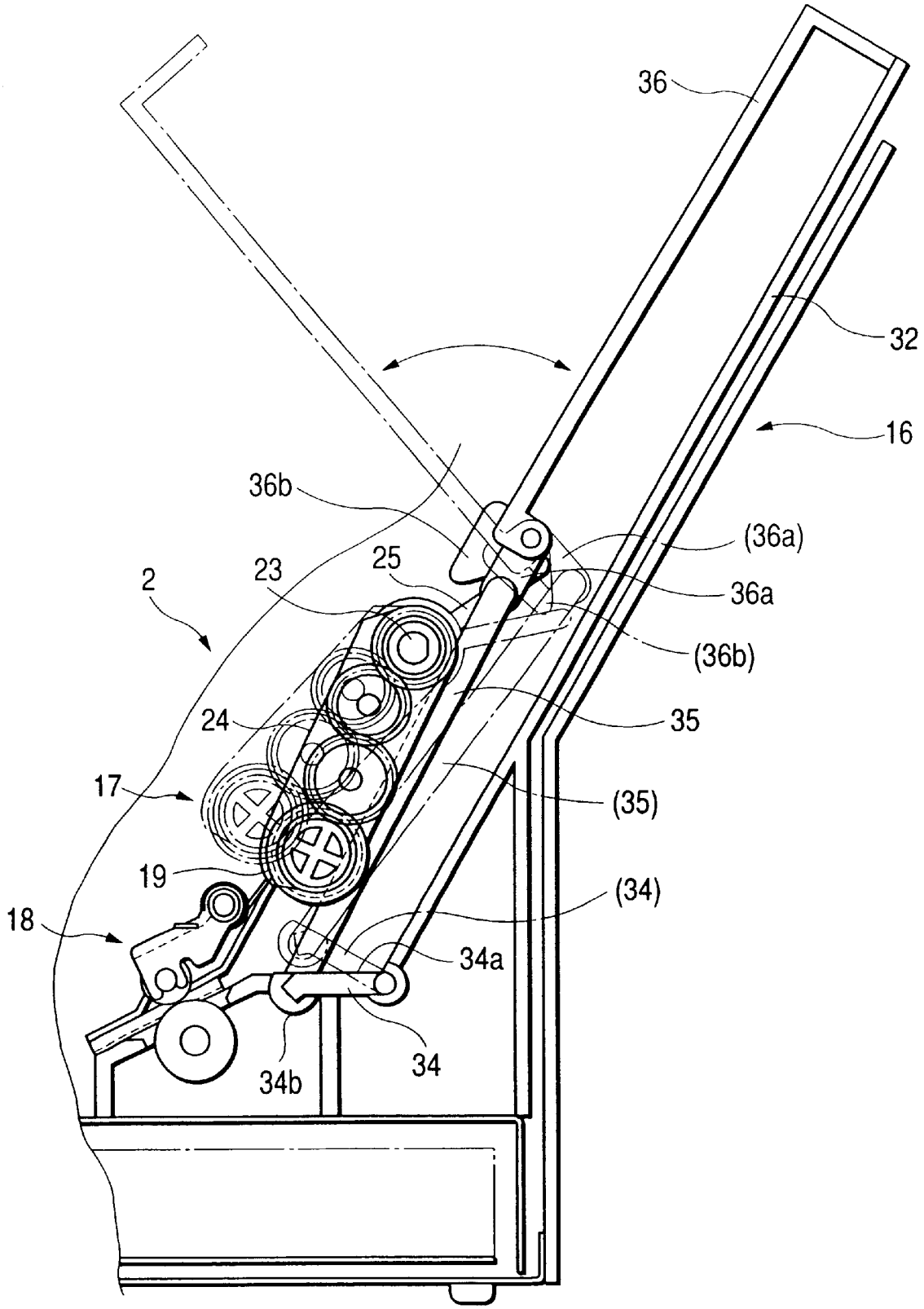
FIG. 4 is a sectional view of a sheet feeding apparatus according to a third embodiment of the present invention.

In the above-mentioned embodiments, while an example that the movable separation inclined surface and the sheet feeding roller holder are shifted by operating the movable inclined surface operation lever 33 was explained, in place of the movable inclined surface operation lever 33, as shown in FIG. 4, the movable separation inclined surface and the sheet feeding roller holder may be shifted by utilizing opening/closing operation of a sheet feeding tray cover 36.

The sheet feeding tray cover 36 is provided with a link arm portion 36*a* and a protruded portion 36*b*. The operation for shifting the movable inclined surface operation lever 33 to the first operation position corresponds to the opening operation of the sheet feeding tray cover 36, and the operation for shifting the movable inclined surface operation lever 33 to the second operation position corresponds to the closing operation of the sheet feeding tray cover 36.

By using the sheet feeding tray cover 36 in place of the movable inclined surface operation lever 33 in this way, when the sheets are inserted onto the sheet feeding tray 32, the operator opens the sheet feeding tray cover 36 to shift the movable inclined surface member 34 to the first position, and, when the sheet feeding operation is effected, the sheet feeding tray cover 36 is closed to shift the movable inclined surface member 34 to the second position. Accordingly, when the sheets are inserted onto the sheet feeding tray 32 or the sheet feeding operation is effected, the movable inclined surface member 34 can be shifted without fail.

According to this embodiment, the same effect as the first embodiment can be achieved, and, since the movable inclined surface member 34 and the sheet feeding roller 19 are shifted in synchronous with the sheet feeding tray cover 36, the operator can perform the operation effected when the sheets are inserted or removed with respect to the sheet feeding tray 32 without fail, thereby providing a sheet feeding apparatus in which the operation can surely be performed.

Figure 5:
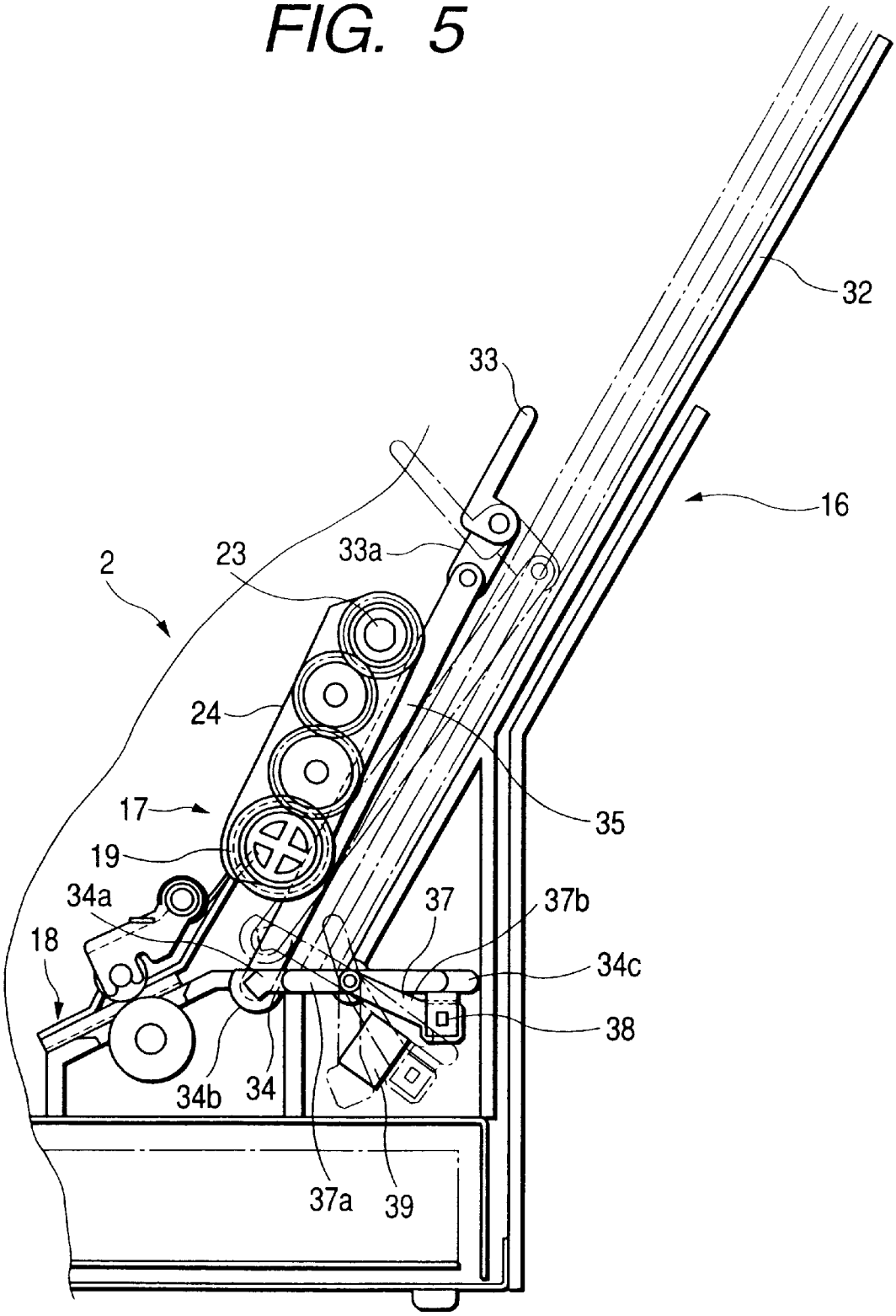
FIG. 5 is a sectional view of a sheet feeding apparatus according to a fourth embodiment of the present invention.

Next, a third embodiment of the present invention will be explained with reference to FIG. 5. Since a schematic construction of an image forming apparatus 1 is the same as that in the first embodiment, explanation thereof will be omitted, and only a sheet feeding apparatus will be fully described. Incidentally, the same elements as those in the first embodiment are designated by the same reference numerals, and detailed explanation thereof will be omitted.

Different from the first embodiment, a sheet feeding tray portion 16 further includes a sheet presence/absence sensor 37, a photo-interrupter 38 and a solenoid 39. The sheet presence/absence sensor 37 is rotatably attached to the rotary shaft of the movable inclined surface member 34 and is constituted by a sensor arm 37*a* and a sensor flag 37*b*. The photo-interrupter 38 is located on an arm portion 34*c* of the movable inclined surface member 34.

When the sheets S are stacked on the sheet feeding tray 32, the sensor arm 37*a* is urged and rotated by the sheets, with the result that the sensor flag 37*b* blocks a light receiving portion of the photo-interrupter 38, thereby maintaining the photo-interrupter 38 in an OFF condition. When the sheets are not stacked on the sheet feeding tray 32, the sensor flag 37*b* is rotated by its own weight to open the light receiving portion of the photo-interrupter 38, with the result that the photo-interrupter 38 is maintained in an ON condition.

The solenoid 39 is secured below the movable inclined surface member 34. The movable inclined surface member 34 is provided with the arm portion 34*c* extending from a rotary fulcrum, which arm portion 34*c* is connected to the solenoid 39.

When the photo-interrupter 38 is in the ON condition, the solenoid 39 is brought to an ON condition, and, when the photo-interrupter 38 is in the OFF condition, the solenoid 39 is brought to an OFF condition. When the solenoid 39 is brought to the ON condition, the arm portion 34*c* of the movable inclined surface member 34 is pulled, thereby shifting the movable inclined surface member 34 to the first position. When the solenoid 39 is brought to the OFF condition, the pulling of the arm portion 34*c* of the movable inclined surface member 34 is released, with the result that the movable inclined surface member 34 can freely be moved.

Now, effect obtained by such arrangement will be described.

When the sheets S are stacked on the sheet feeding tray 32, the pulling of the arm portion 34*c* of the movable inclined surface member 34 by means of the solenoid 39 is released. In the case where the sheets S are inserted onto the sheet feeding tray 32 for sheet replenishment, when the movable inclined surface operation lever 33 is shifted to the first operation position, the link arm portion 33*a* is rotated round the rotary shaft, thereby shifting the arm 35. In synchronous with the arm 35, the movable inclined surface member 34 is shifted to the first position where the movable separation inclined surface 34*a* becomes substantially perpendicular to the sheet stacking surface of the sheet feeding tray 32.

In this condition, if the sheet stack is inserted forcibly, since the sheet stack abuts against the movable separation inclined surface 34*a* of the movable inclined surface member 34 substantially perpendicular thereto, the sheet stack is not deformed. Thus, the double feeding due to such deformation can be prevented.

In the case where the sheets stacked on the sheet feeding tray 32 are fed, when the movable inclined surface operation lever 33 is shifted to the second operation position and is locked there, the link arm portion 33*a* is rotated around the rotary shaft, thereby shifting the arm 35. The movable inclined surface member 34 is also rotated to the second position where the angle between the movable separation inclined surface 34*a* and the sheet stacking surface of the sheet feeding tray 32 becomes more obtuse angle than that in the first position. When the sheet feeding operation is performed in this condition, the sheets can be separated positively.

When all of the sheets are fed and the sheet feeding tray 32 becomes empty, the sheet presence/absence sensor 37 is rotated to turn ON the photo-interrupter 38. As a result, the solenoid 39 is also turned ON, thereby pulling the arm portion 34*c* of the movable inclined surface member 34. When the movable inclined surface operation lever 33 is in the second operation position, the lock is released, with the result that the movable inclined surface member 34 is automatically shifted to the first position, and the movable inclined surface operation lever 33 is locked at the first operation position. If the sheet stack is inserted forcibly in this condition, since the sheet stack abuts against the movable separation inclined surface 34*a* of the movable inclined surface member 34 substantially perpendicular thereto, the sheet stack is not deformed. Thus, the double feeding due to such deformation can be prevented.

When the sheets are stacked on the sheet feeding tray 32, since the sheet presence/absence sensor 37 turns OFF the photo-interrupter 38 to indicate the presence of sheets, the solenoid 39 is turned OFF, thereby releasing the pulling of the arm portion 34*c* of the movable inclined surface member 34. In the case where the sheets stacked on the sheet feeding tray 32 are fed, when the movable inclined surface operation lever 33 is shifted to the second operation position and is locked there, the movable inclined surface member 34 is rotated to the second position. When the sheet feeding operation is performed in this condition, the sheets can be separated positively.

By operating the movable inclined surface operation lever 33 as mentioned above, when the sheets are inserted, since the movable inclined surface member 34 is always located at the first position where the movable separation inclined surface 34*a* becomes substantially perpendicular to the sheet stacking surface of the sheet feeding tray 32, when the sheet stack abuts against the movable separation inclined surface 34*a*, the sheet stack is not slipped and, thus, the end of the sheet stack is not deformed. When the movable inclined surface operation lever 33 is operated, the movable inclined surface member 34 is rotated to the second position. Since this operation is performed slowly, the end of the sheet stack is not deformed by this operation. Accordingly, even if the operator inserts the sheet stack onto the sheet feeding tray 32, the end of the sheet stack is not deformed, and, when the sheet feeding operation is effected, the double feeding due to deformation of the ends of the sheets can be prevented. Further, the number of sheets which can be stacked on the sheet feeding tray 32 can be increased.

When any sheet is not rested on the sheet feeding tray 32, since the movable inclined surface member 34 is automatically shifted to the first position, if the operator does not operate the operation lever intentionally when the sheets are inserted onto the sheet feeding tray 32, the ends of the sheets are not deformed, and, thus, the double feeding due to such can be prevented. Further, since the ends of the sheets are not deformed, the number of sheets which can be stacked on the sheet feeding tray 32 can be increased.

In this way, according to this embodiment, since the deformation of the end of the sheet stack can positively be prevented when the sheet stack is inserted onto the sheet feeding tray 32, the double feeding is hard to occur, and the larger number of sheets can be stacked. Further, when there is no sheet on the sheet feeding tray 32, even if the operator does not perform the operation, the same effect as the above can be achieved.

Incidentally, in this embodiment, while an example that the lever is used for shifting the movable inclined surface member 34 was explained, the present invention is not limited to such an example, but any switchable arrangement such as a toggle switch may be used. Further, as mentioned in the second embodiment, the movable inclined surface member 34 may be shifted in synchronous with the opening/closing operation of the sheet feeding tray cover. Further, as shown in the first embodiment, when the movable inclined surface member 34 is shifted to the first position, the sheet feeding roller 19 may be spaced apart from the sheet feeding tray 32.

In the above-mentioned embodiments, while an example that the movable inclined surface operation lever 33 is locked by the locking means was explained, the present invention is not limited to such an example, but the movable inclined surface member 34 may be locked at the first and second positions.

Further, in the above-mentioned embodiments, while an example that the rotary fulcrum of the movable inclined surface member 34 is located near the sheet feeding tray 32 was explained, the rotary fulcrum may be located near the sheet feeding-out end of the movable inclined surface member 34. In this case, the rotational direction of the movable inclined surface operation lever 33 becomes opposite to that in the above-mentioned embodiments.

Next, a fourth embodiment of the present invention will be explained with reference to the accompanying drawings. Incidentally, in this embodiment, the present invention is applied to a sheet feeding apparatus having a sheet feeding cassette detachably attachable to a main body of the apparatus. First of all, an image forming apparatus 100 having the sheet feeding apparatus according to the present invention will be briefly described.

The entire construction of the image forming apparatus 100 will be explained with reference to FIG. 8. The image forming apparatus 100 includes a sheet feeding apparatus 102 for containing and feeding sheets S on which images are to be formed, an image forming portion 103 provided in a main body 100*a* of the apparatus and adapted to form the image on the sheet fed from the sheet feeding apparatus 102, discharge means 104 for discharging the sheet on which the image was formed in the image forming portion 103, and sheet stacking means 105 for stacking the discharged sheets. In the image forming portion 103, a light image corresponding to target image information from an optical system 106 is illuminated onto a photosensitive drum 107 as an image bearing member by exposing means (slit focusing projection means for an original image or laser scan exposing means; not shown), thereby forming a latent image which is in turn visualized by developer (referred to as "toner" hereinafter) as a toner image.

In synchronous with formation of the toner image, the sheet is fed from the sheet feeding apparatus 102, and the toner image formed on the photosensitive drum 107 is transferred onto the sheet by a transfer roller 108 as transferring means. The sheet to which the toner image was transferred is sent to fixing means 109 comprised of a fixing rotary member 109*a* including a heater therein and a driving roller 109*b* urged against the fixing rotary member 109*a*, where the toner image is fixed to the sheet.

The image forming portion 103 includes a process cartridge 114 comprising the rotatable photosensitive drum 107 having a photosensitive layer, a charge roller 110 as charging means for uniformly charging the surface of the photosensitive drum 107 by applying voltage, developing means 111 for developing the surface of the photosensitive drum 107 on which the latent image was formed by the light image from the optical system 106, cleaning means 112 for removing residual toner remaining on the surface of the photosensitive drum 107 after the toner image was transferred to the sheet by the transfer roller 108, and a waste toner container 113 for collecting the removed toner.

Figure 8:
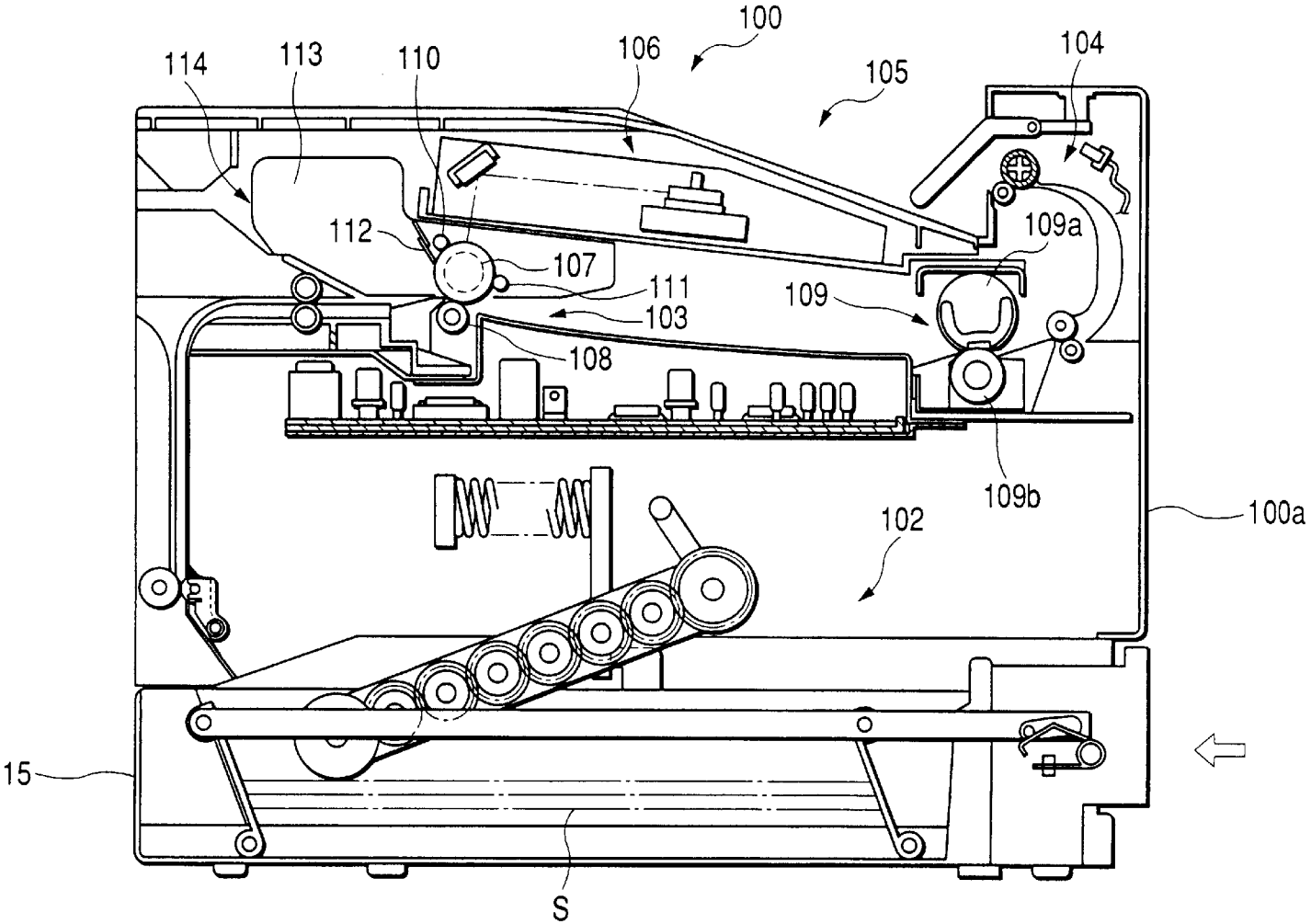
FIG. 8 is a sectional view of an image forming apparatus having the sheet feeding apparatus according to the fifth embodiment.

The sheet feeding apparatus 102 is provided with a sheet feeding cassette 115 to be mounted to the main body 110*a* of the apparatus, and the sheet feeding cassette 115 is mounted to the main body 110*a* of the apparatus along a direction shown by the arrow in FIG. 8.

Figure 6:
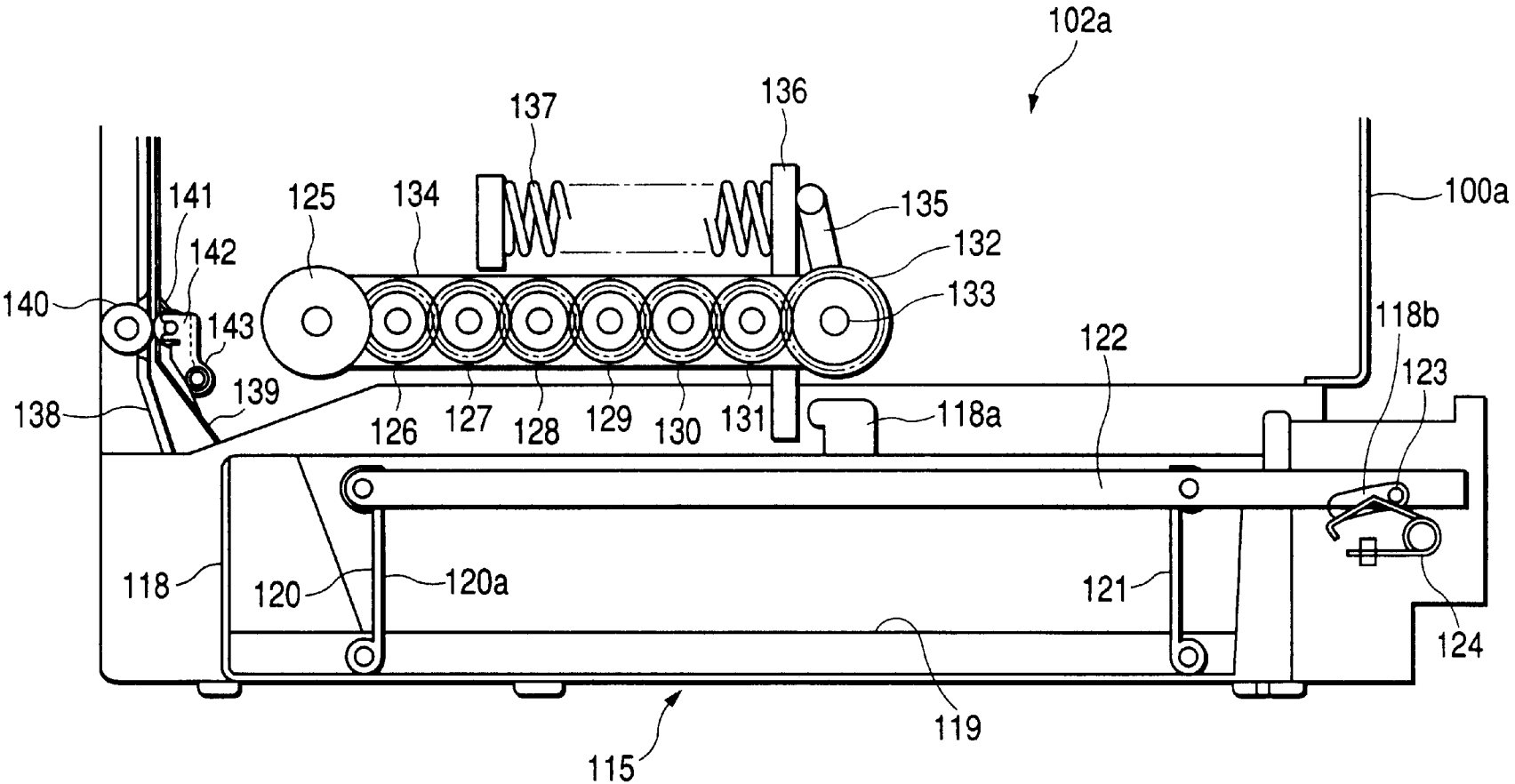
FIGS. 6 and 7 are sectional views of a sheet feeding apparatus according to a fifth embodiment of the present invention.
Figure 7:
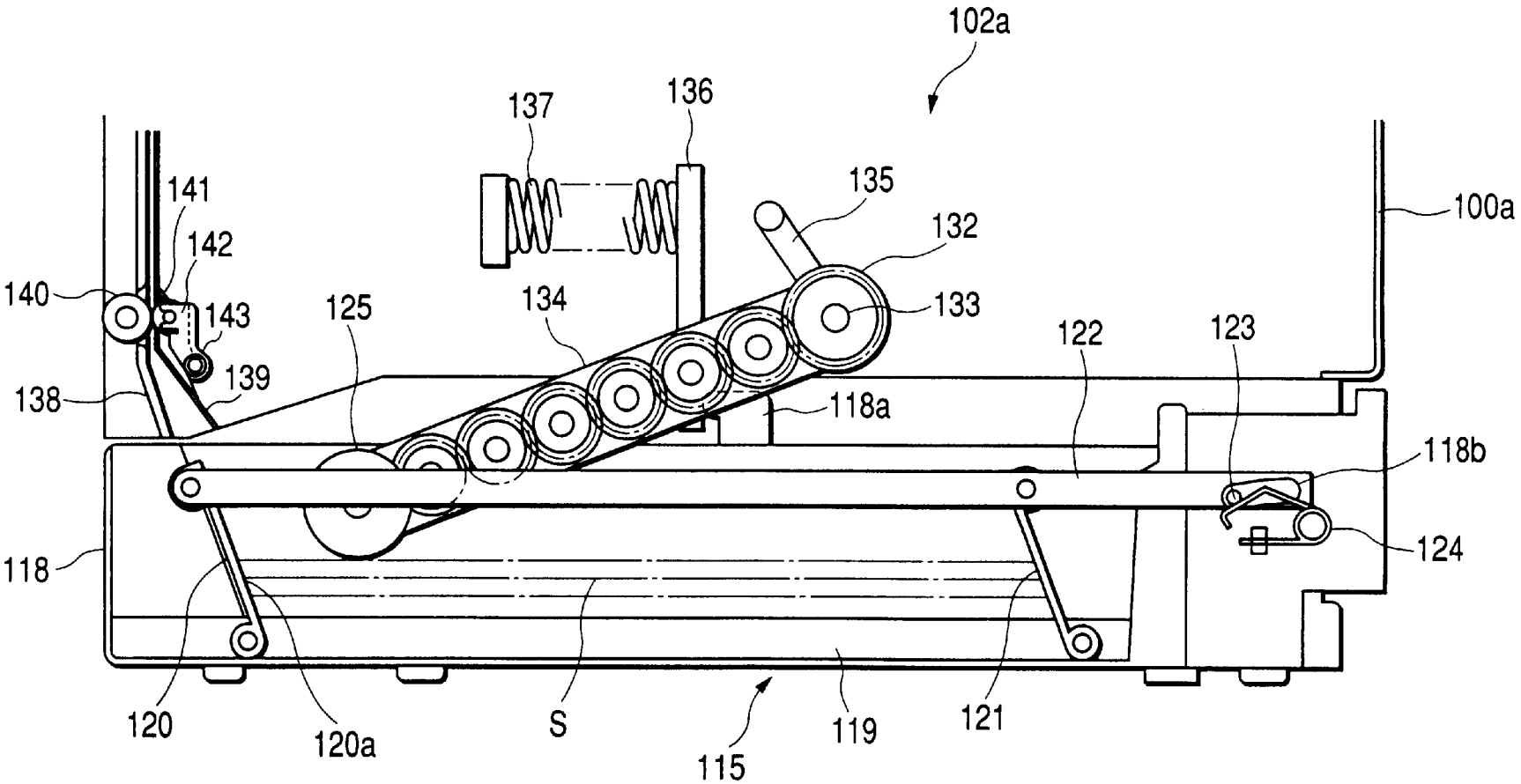

Next, the sheet feeding apparatus 102 according to the present invention will be explained with reference to FIGS. 6 and 7. Incidentally, FIG. 6 shows a condition before the sheet feeding cassette 115 is mounted to the main body 110*a* of the apparatus, and FIG. 7 shows a condition after the sheet feeding cassette 115 is mounted to the main body 110*a* of the apparatus.

The sheet feeding apparatus 102 comprises the sheet feeding cassette 115 for stacking sheets S to be fed, a sheet feeding portion 102*a* for feeding the stacked sheets successively, and a conveying portion for conveying the fed sheet.

The sheet feeding cassette 115 includes a cassette body 118 constituting an outer frame, a sheet stacking surface 119 for stacking the sheets to be fed, a movable inclined surface member 120 having a movable separation inclined surface 120*a* for separating the sheets for abutting the sheets against the separation inclined surface, and a trailing end regulating plate 121 for regulating a trailing end of the sheet stack S. Further, a protruded portion 118*a* is formed on an upper part of the cassette body 118.

The movable inclined surface member 120 and the trailing end regulating plate 121 are rotatably attached to the sheet stacking surface 119, and a link arm 122 is rotatably attached with respect to an end of the movable inclined surface member 120 and an end of the trailing end regulating plate 121. By this link mechanism, the movable inclined surface member 120 and the trailing end regulating plate 121 are rotated always in parallel.

A switching lever 123 is integrally attached to the link arm 122. The switching lever 123 is protruded outwardly from the cassette body 118 through a hole 118*b* formed in a side surface of the cassette body. The switching lever 123 is biased by a lever biasing spring 124 so that the switching lever 123 is fixed at a first position (shown in FIG. 6) or a second position (shown in FIG. 7).

The sheet feeding portion 102*a* is provided in the main body 100*a* of the apparatus and includes a sheet feeding roller 125 rotated integrally with a gear (not shown), an idler gear A126 meshed with the gear (not shown), an idler gear B127 meshed with the idler gear A126, an idler gear C128 meshed with the idler gear B127, an idler gear D129 meshed with the idler gear C128, an idler gear E130 meshed with the idler gear D129, an idler gear F131 meshed with the idler gear E130, a drive gear 132 meshed with the idler gear F131, a drive shaft 133 rotated integrally with the drive gear 132, and a sheet feeding roller holder 134 adapted to rotatably support the sheet feeding roller 125, idler gears A126, F131 and drive gear 132 and rotatably attached to the drive shaft 133.

The drive shaft 133 is controlled by controlled drive means to be driven in the sheet separating and feeding operation. Further, a push-up arm 135 is integrally formed with the sheet feeding roller holder 134. A push-up plate 136 is attached to the main body 100*a* of the apparatus for parallel movement, and the push-up plate 136 is biased by a push-up plate biasing spring 137 to push the sheet feeding roller 125 upwardly by pushing the push-up arm 135.

As shown in FIG. 7, when the sheet feeding cassette 115 is inserted into the main body, the protruded portion 118*a* of the cassette body 118 pushes the push-up plate 136 toward a direction opposite to the biasing direction. Since the push-up arm 135 is released from the biasing of the push-up plate 136, the sheet feeding roller 125 is rested on the upper surface of the sheet stack S rested on the sheet feeding cassette 115 by its own weight.

The conveying portion includes a lower guide 138 for guiding a lower surface of the fed sheet, an upper guide 139 for guiding an upper surface of the fed sheet, a conveying roller 140 for conveying the fed sheet toward a predetermined direction, a rotatable conveying sub-roller 141 opposed to the conveying roller 140, a sub-roller holder 142 rotatably supported by the upper guide 139 and adapted to rotatably support the conveying sub-roller 141, and a conveying spring 143 for biasing the sub-roller holder 142 to urge the conveying sub-roller 141 against the conveying roller 140.

In the above-mentioned arrangement, a sheet replenishing operation is performed as follows.

The sheet feeding cassette 115 is drawn from the main body 110*a* of the apparatus and the switching lever 123 is switched to the first operation position shown in FIG. 6. In synchronous with the movement of the link arm 122, the movable inclined surface member 120 and the trailing end regulating plate 121 are rotated and are fixed at a position where the movable separation inclined surface 120*a* of the movable inclined surface member 120 becomes substantially perpendicular to the sheet stacking surface 119. In this condition, the sheets are replenished on the sheet stacking surface 119.

In this condition, the sheet feeding cassette 115 is inserted into the main body again, and the switching lever 123 is switched to the second operation position shown in FIG. 7. In synchronous with the movement of the link arm 122, the movable inclined surface member 120 and the trailing end regulating plate 121 are rotated and are fixed at a position where the movable separation inclined surface 120*a* of the movable inclined surface member 120 forms an obtuse angle with respect to the sheet stacking surface 119.

The above-mentioned arrangement provides the following advantages.

By operating the switching lever 123 as mentioned above, when the sheets are replenished, since the movable separation inclined surface 120*a* of the movable inclined surface member 120 is located substantially perpendicular to the sheet stacking surface 119, the sheets can easily be replenished. Even if the operator inserts the sheet feeding cassette 115 into the main body forcibly, since the movable separation inclined surface 120*a* is located substantially perpendicular to the inserting direction, even when the sheets abut against the movable separation inclined surface 120*a*, the sheets are not slipped and ends of the sheets are not deformed. Further, the sheets are not excessively advanced along the movable separation inclined surface 120*a*, thereby preventing the cassette from being deviated from the proper cassette position.

After the sheet feeding cassette 115 was inserted, since the movable inclined surface member 120 is rotated by operating the switching lever 123 so that the movable separation inclined surface 120*a* forms an obtuse angle with respect to the sheet stacking surface 119, the leading end portions of the sheets are not deformed.

Even if the operator inserts the sheet feeding cassette 115 into the main body 100*a* of the apparatus forcibly in this way, since the sheets S abut against the movable separation inclined surface 120*a* located substantially perpendicular to the inserting direction, the leading end portions of the sheets are not deformed and the sheets are not excessively advanced. Thus, in the sheet feeding operation, the double feeding due to deformation of the ends of the sheets can be prevented.

In this way, according to this embodiment, when the sheet feeding cassette 115 is inserted into the main body 100*a* of the apparatus, since the deformation of the ends of the sheets S can be prevented positively, a sheet feeding apparatus capable of preventing the double feeding can be realized.

Incidentally, in this embodiment, while an example that the lever is used for shifting the movable separation inclined surface 120*a* was explained, the present invention is not limited to such an example, but any switchable arrangement such as a toggle switch may be used.

Figure 9:
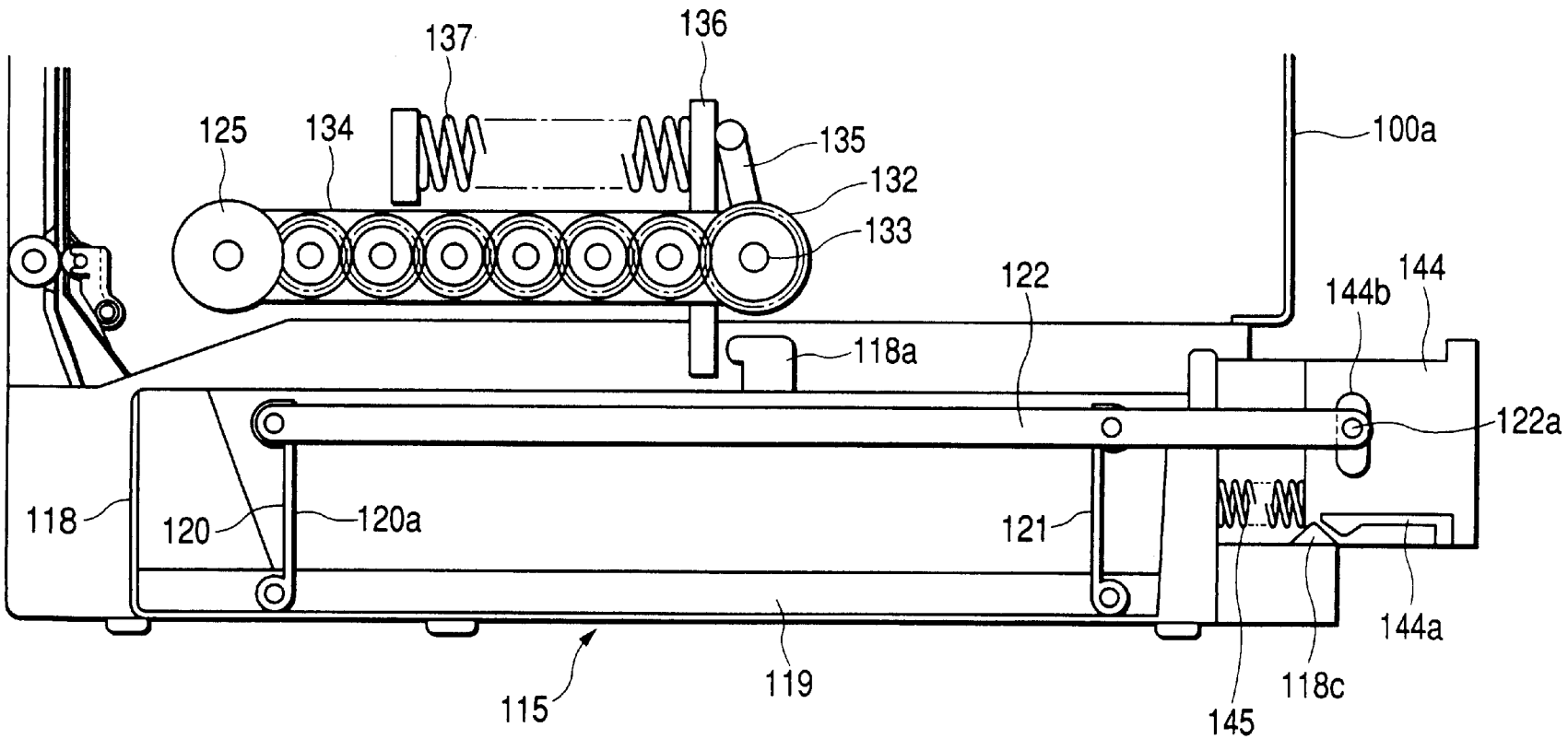
FIGS. 9, 10 and 11 are sectional views of a sheet feeding apparatus according to a sixth embodiment of the present invention.
Figure 10:
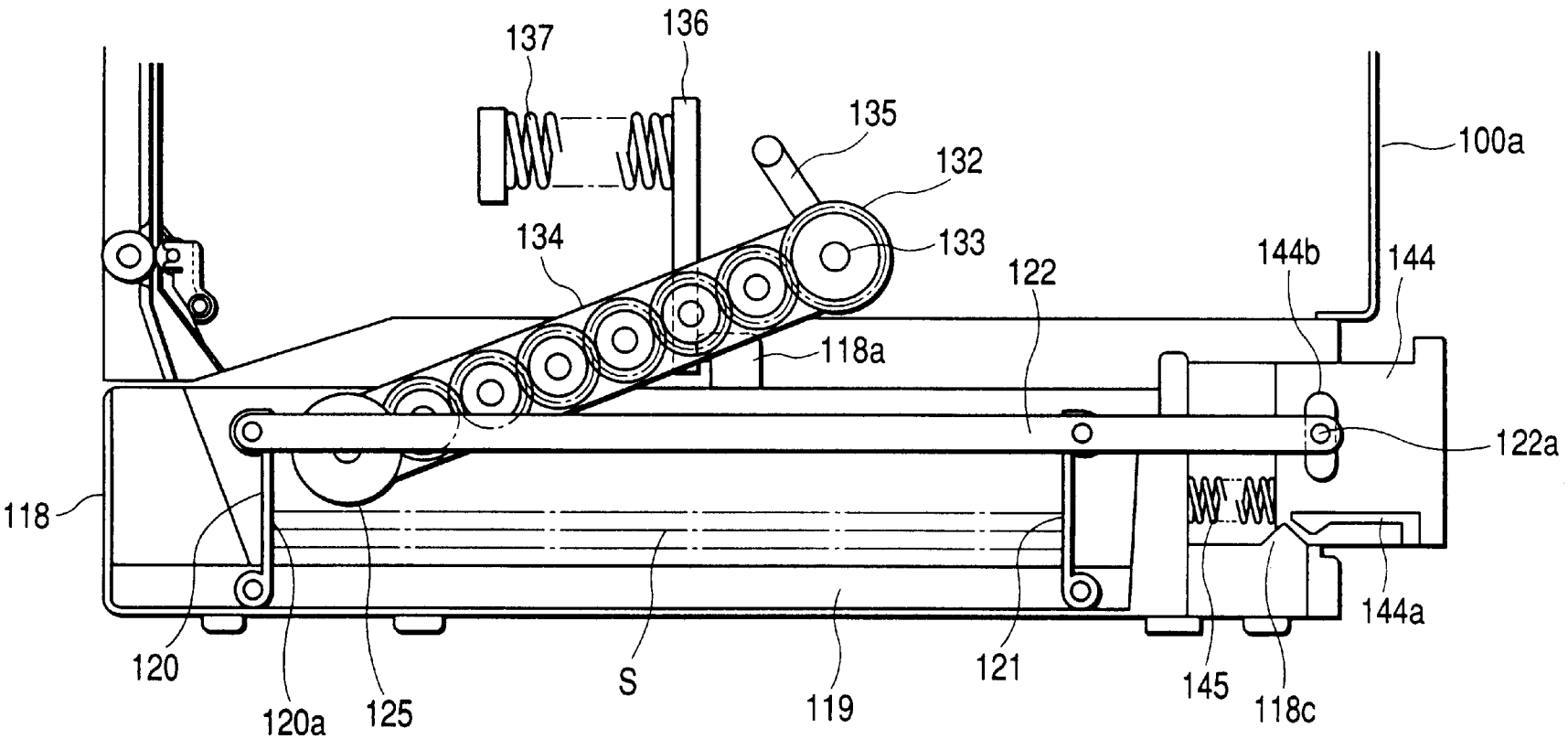
Figure 11:
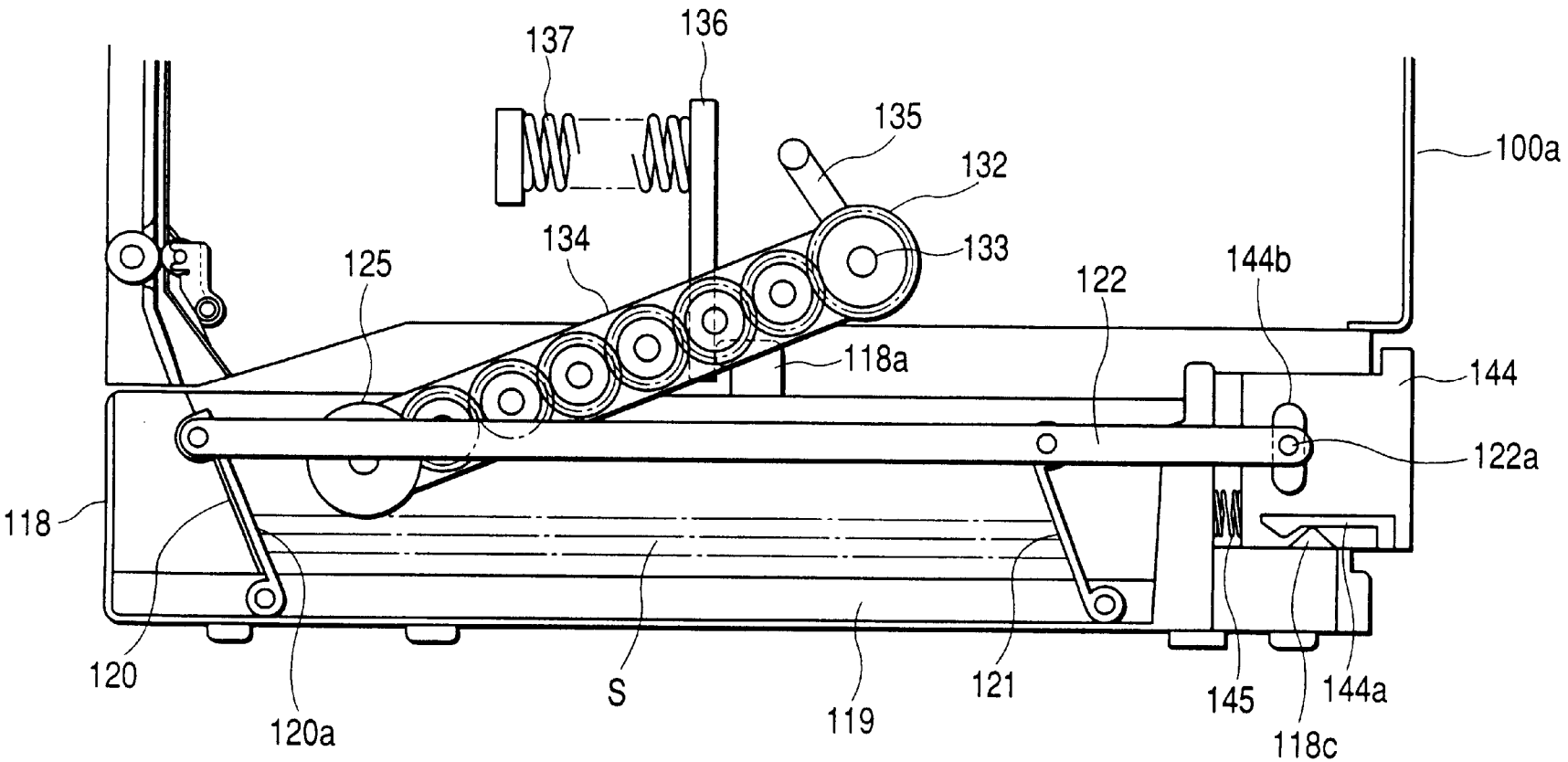

Next, a fifth embodiment of the present invention will be explained with reference to FIGS. 9 to 11. Incidentally, since a construction of an image forming apparatus 101 is the same as that in the fourth embodiment, explanation thereof will be omitted, and only a sheet feeding apparatus 102 will be fully described. Incidentally, the same elements as those in the fourth embodiment are designated by the same reference numerals, and detailed explanation thereof will be omitted.

A sheet feeding cassette 115 include a cassette body 118 constituting an outer frame, a sheet stacking surface 119 for stacking the sheets to be fed, a movable inclined surface member 120 having a movable separation inclined surface 120*a* for separating the sheets by abutting the sheets against the separation inclined surface, and a trailing end regulating plate 121 for regulating a trailing end of the sheet stack. Further, a protruded portion 118*a* is formed on an upper part of the cassette body 118.

The movable inclined surface member 120 and the trailing end regulating plate 121 are rotatably attached to the sheet stacking surface 119, and a link arm 122 is rotatably attached with respect to an end of the movable inclined surface member 120 and an end of the trailing end regulating plate 121. By this link mechanism, the movable inclined surface member 120 and the trailing end regulating plate 121 are rotated always in parallel.

A grip 144 used for mounting and dismounting of the sheet feeding cassette 115 is attached to an end of the link arm 122 for sliding movement with respect to the cassette body 118 and has an elastic engagement portion 144*a* and an elongated hole 144*b*.

A grip biasing spring 145 biases the grip 144 toward a direction along which the grip is pushed out from the cassette body 118. The link arm 122 is provided at its end with a boss 122*a* which is engaged by the elongated hole 144*b* of the grip 144. With this arrangement, the link arm 122 is moved in synchronous with the grip 144. The cassette body 118 is provided with a projection 118*c* for engagement with the elastic engagement portion 144*a* of the grip 144. The grip 144 is fixed at a first operation position shown in FIG. 9 and a second operation position shown in FIG. 11.

In the above-mentioned arrangement, a sheet replenishing operation is performed as follows.

The sheet feeding cassette 115 is drawn from the main body of the apparatus by drawing the grip 144. The elastic engagement portion 144*a* of the grip 144 ridges over the projection 118*c* of the cassette body 118, with the result that the grip 144 is shifted with respect to the cassette body 118. The link arm 122 is also shifted in synchronous with the shifting movement of the grip 144. The movable inclined surface member 120 and the trailing end regulating plate 121 are rotated to be shifted to and fixed at the first position perpendicular to the sheet stacking surface 119 as shown in FIG. 9.

In this condition, the sheets are replenished on the sheet stacking surface 119, and the sheet feeding cassette 115 is inserted into the main body 100*a* of the apparatus by pushing grip 144. When inserted, first of all, the cassette body 118 is moved integrally with the grip 144, and, as shown in FIG. 10, after the cassette body 118 abuts against and fixed by the main body 100*a* of the apparatus, the grip 144 is further pushed-in.

The elastic engagement portion 144*a* of the grip 144 rides over the projection 118*c* of the cassette body 118, with the result that the grip 144 is shifted with respect to the cassette body 118. The link arm 122 is also shifted in synchronous with the shifting movement of the grip 144. The movable inclined surface member 120 and the trailing end regulating plate 121 are rotated to be shifted to and fixed at the second position where the movable separation inclined surface 120*a* forms an obtuse angle with respect to the sheet stacking surface 119 as shown in FIG. 11.

The above-mentioned arrangement provides the following advantages.

By drawing the grip 144 as mentioned above, when the sheets S are replenished, the movable separation inclined surface 120*a* of the movable inclined surface member 120 is always located substantially perpendicular to the sheet stacking surface 119, the sheets can easily be replenished. Even if the operator inserts the sheet feeding cassette 115 into the main body 100*a* of the apparatus via the grip 144 forcibly, since the movable separation inclined surface 120*a* is located substantially perpendicular to the inserting direction, when the sheet stack abuts against the movable separation inclined surface 120*a*, the sheet stack is not slipped, not deformed and not excessively advanced.

After the cassette body 118 is inserted and positioned with respect to the main body 100*a* of the apparatus again, when the grip 144 is further pushed in, since the movable separation inclined surface 120*a* of the movable inclined surface member 120 forms the obtuse angle with respect to the sheet stacking surface 119, the leading end of the sheet stack S is not deformed.

In this way, if the sheet feeding cassette 115 is inserted into the main body 100*a* of the apparatus forcibly, since the sheet stack S always abuts against the movable separation inclined surface 120*a* of the movable inclined surface member 120 located substantially perpendicular to the inserting direction, the leading end of the sheet stack S is not deformed. Thus, the double feeding due to deformation of the leading ends of the sheets can be suppressed.

Further, when the sheets are replenished, since the angle of the movable separation inclined surface 120*a* is switched only by the drawing/pushing operation of the grip 144, the operation is simplified and erroneous operation can be prevented.

In this way, according to this embodiment, when the sheet feeding cassette 115 is inserted into the main body of the apparatus, since the leading ends of the sheets S are not deformed positively, a sheet feeding apparatus in which the double feeding can surely be suppressed and the operation is simplified and the erroneous operation can be minimized can be realized.

Next, a sixth embodiment of the present invention will be explained with reference to FIGS. 12 and 13. Incidentally, in this embodiment, the present invention is applied to a sheet feeding apparatus having a fixed sheet feeding tray portion.

Since a schematic construction of an image forming apparatus 101 is similar to that in the fourth embodiment, explanation thereof will be omitted, and only a sheet feeding apparatus 102 will be fully described. Incidentally, the same elements as those in the fourth embodiment are designated by the same reference numerals and detailed explanation thereof will be omitted.

The sheet feeding apparatus 102 comprises a sheet feeding tray portion 146 for stacking sheets S to be fed, a sheet feeding portion 102*a* for feeding the stacked sheets successively, and a conveying portion for conveying the fed sheet.

The sheet feeding tray portion 146 includes a sheet feeding tray 147 for stacking sheets to be fed, and a movable inclined surface member 120 having a movable separation inclined surface 120*a* for separating the sheets for abutting the sheets against the separation inclined surface. The movable separation inclined surface 120*a* is rotatably attached with respect to the sheet feeding tray 147.

One end of a link arm 122 is rotatably attached with respect to an end of the movable inclined surface member 120 and a switching lever 123 is integrally attached to the other end of the link arm 122. The switching lever 123 is protruded outwardly from the main body 100*a* of the apparatus through a hole 101*a* formed in a side surface of the main body. The switching lever 123 is biased by a lever biasing spring 124 so that the switching lever 123 is positioned at a first operation position shown in FIG. 12 or a second operation position shown in FIG. 13.

In the above-mentioned arrangement, the sheets are replenished as follows.

Figure 12:
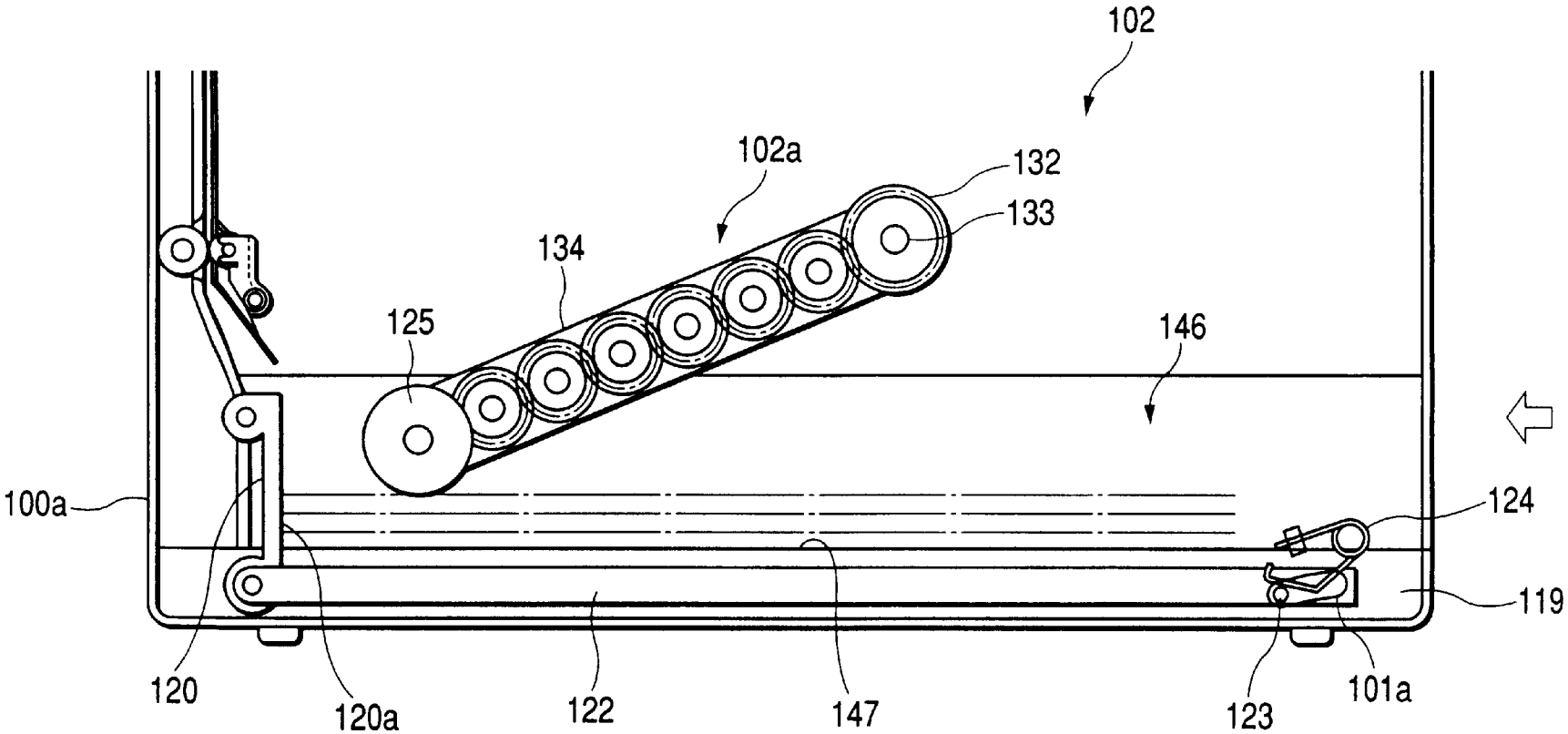
FIGS. 12 and 13 are sectional views of a sheet feeding apparatus according to a seventh embodiment of the present invention.

When the switching lever 123 is positioned at the first operation position shown in FIG. 12, the movable inclined surface member 120 is rotated in synchronous with movement of the link arm 122 to be positioned at a position where the movable separation inclined surface 120*a* of the movable inclined surface member 120 becomes perpendicular to the sheet stacking surface 119. In this condition, the sheets are inserted onto the sheet stacking surface 119.

Figure 13:
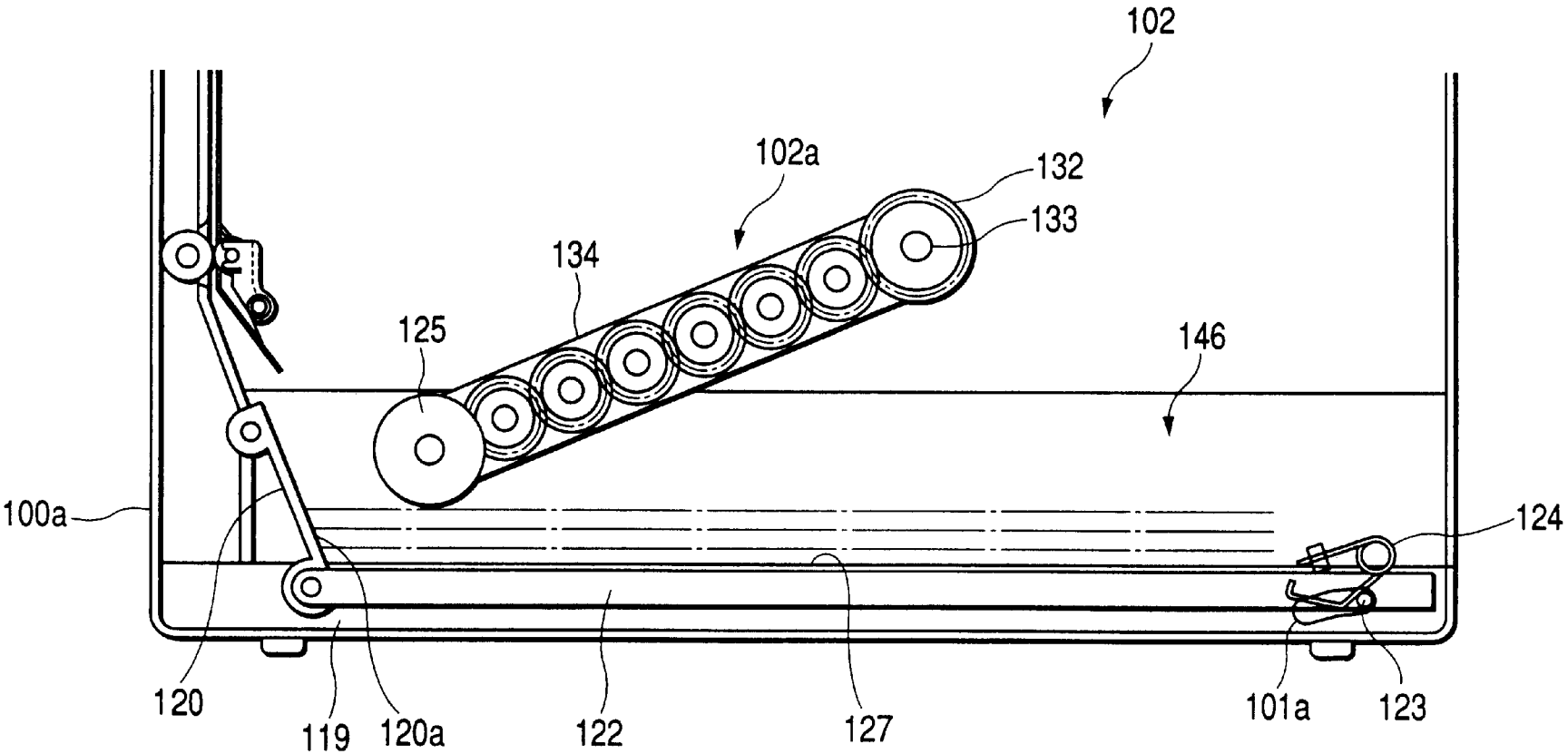
Figure 14:
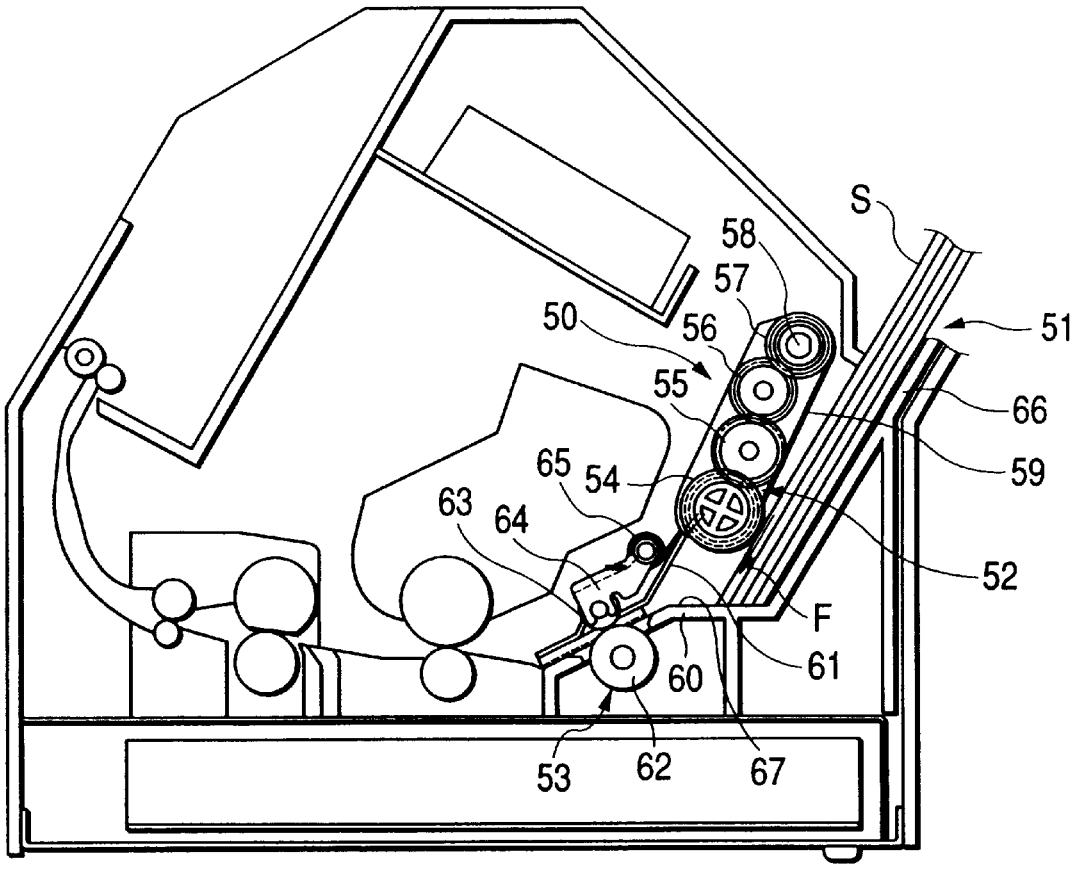
FIG. 14 is a sectional view of a conventional sheet feeding apparatus.
Figure 15:
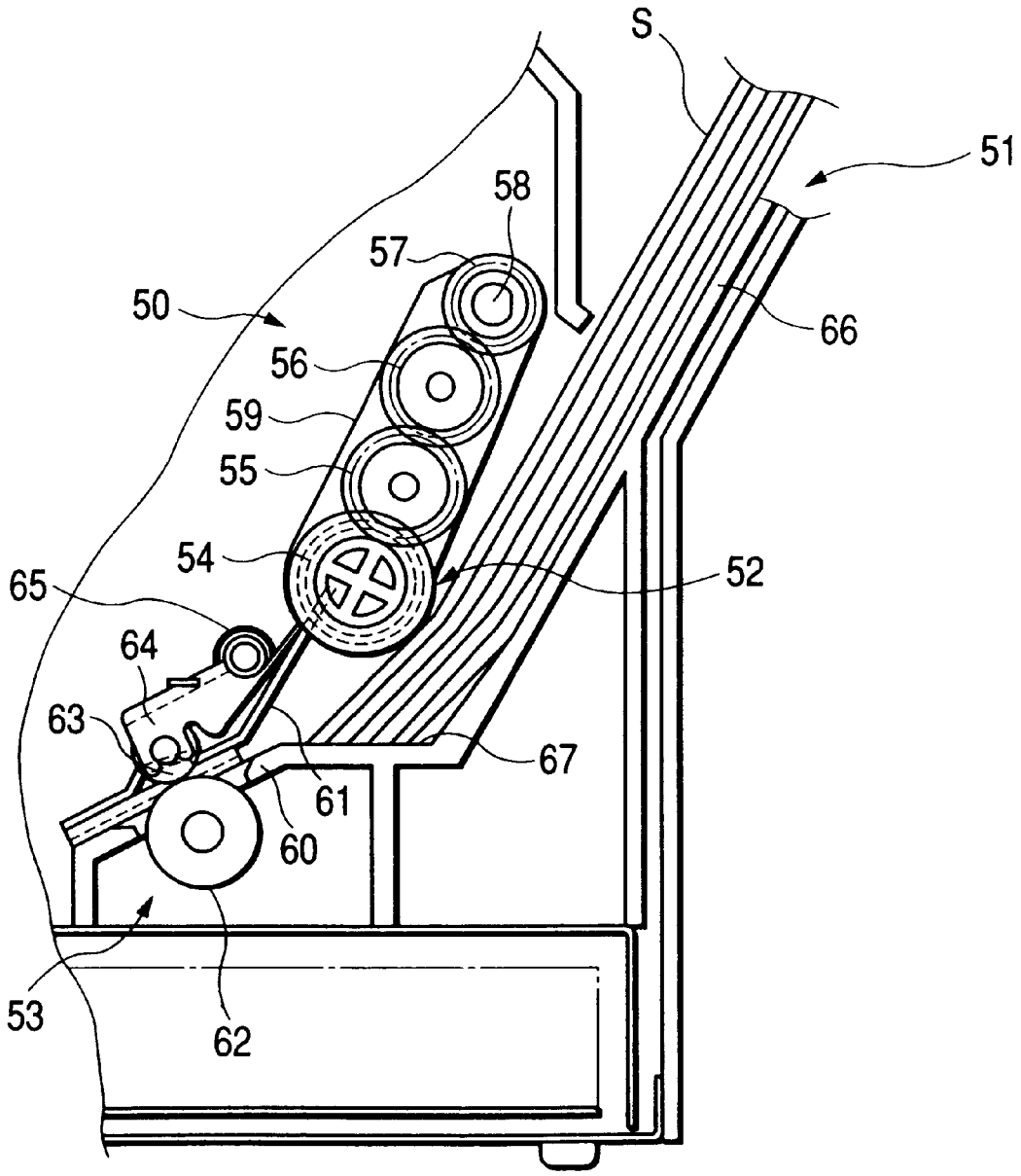
FIG. 15 is a view for explaining a problem that double-feeding happens often in the conventional sheet feeding apparatus.
Figure 16:
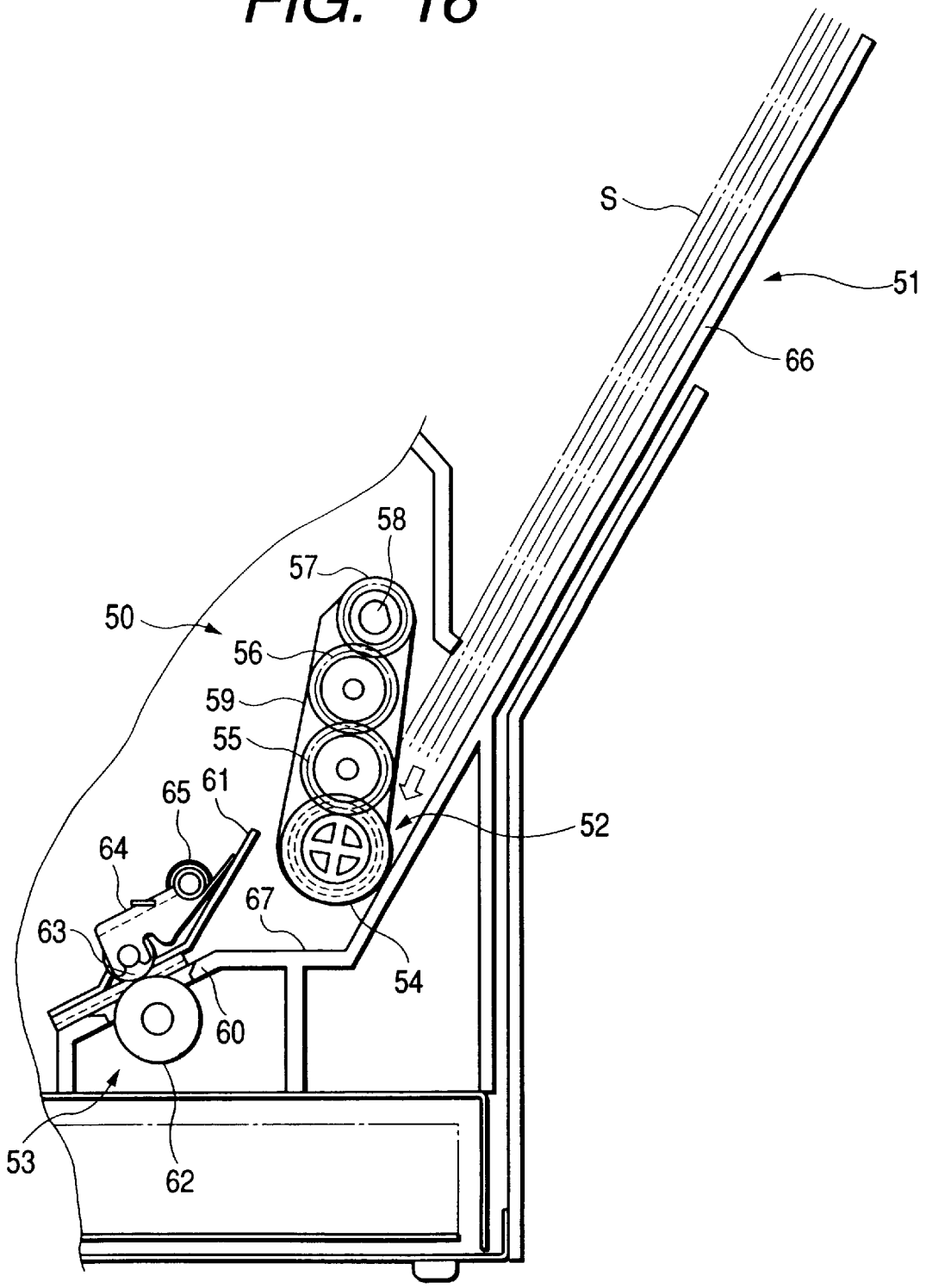
FIG. 16 is a view for explaining a problem regarding damage of a sheet feeding roller in the conventional sheet feeding apparatus.
Figure 17:
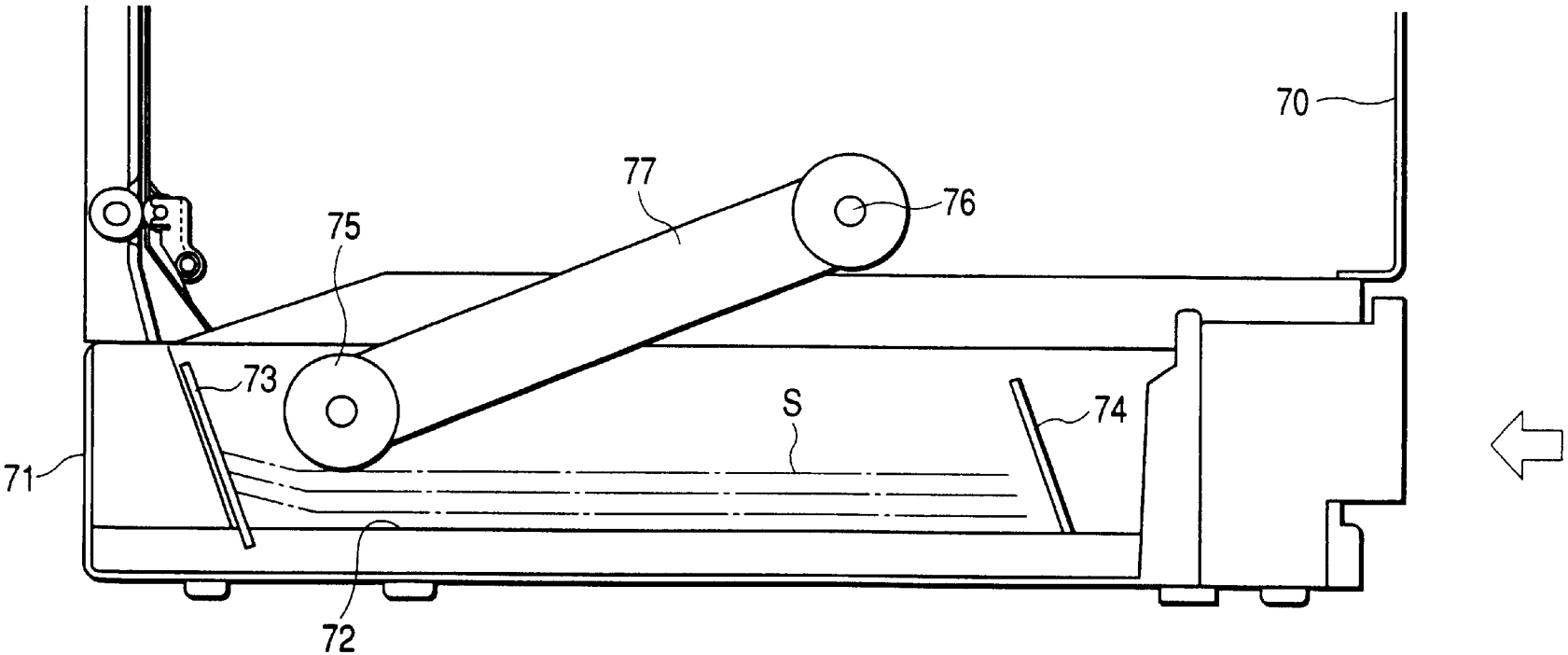
FIG. 17 is a sectional view of another conventional sheet feeding apparatus.

When the switching lever 123 is positioned at the second operation position shown in FIG. 13, the movable inclined surface member 120 is rotated in synchronous with movement of the link arm 122 to be positioned at a position where the movable separation inclined surface 120*a* of the movable inclined surface member 120 forms an obtuse angle with respect to the sheet stacking surface 119.

The above-mentioned arrangement provides the following advantages.

By operating the switching lever 123 as mentioned above, even if the operator inserts the sheet stack onto the sheet feeding tray 147 forcibly from a direction shown by the arrow in FIG. 12, since the movable inclined surface member 120 is located substantially perpendicular to the inserting direction, when the sheets abut against the movable separation inclined surface 120*a*, the sheets are not slipped and ends of the sheets are not deformed. After the insertion of the sheets is finished, when the switching lever 123 is operated, since the movable separation inclined surface 120*a* of the movable inclined surface member 120 forms the obtuse angle with respect to the sheet stacking surface 119, the leading ends of the sheets are not deformed.

In this way, if the operator inserts the sheet stack onto the sheet feeding tray 147 forcibly, since the sheets always abut against the movable inclined surface member 120 located substantially perpendicular to the inserting direction, the leading ends of the sheets are not deformed and the sheets are not excessively advanced. Thus, in the sheet feeding operation, the double feeding due to deformation of the leading ends of the sheets can be suppressed.

Incidentally, in this embodiment, the sheet feeding roller 125 attached to the sheet feeding roller holder 134 rotatably supported by the drive shaft 133 may be lifted and lowered by a retard mechanism so that it is lifted not to interfere with the insertion of the sheet stack when the sheet stack S is inserted onto the sheet feeding tray 147 and it is lowered to abut against the upper surface of the sheet stack in the sheet feeding operation. In this case, control may be effected so that, whenever the sheet is fed, the lifting/lowering of the sheet feeding roller 125 is repeated or that, when the sheets are replenished, the sheet feeding roller 125 is lifted and retarded.

In this way, according to this embodiment, in the sheet feeding apparatus having the multi-sheet feeding tray, when the sheets are inserted onto the sheet feeding tray, since the leading ends of the sheets are not deformed, the double feeding can be prevented.

What is claimed is:

1. A sheet feeding apparatus comprising:

a sheet stacking surface for supporting sheets;

sheet feeding means for feeding out the sheets supported on said sheet stacking surface;

a movable separation inclined surface against which leading ends of the sheets supported on said sheet stacking surface abut and which is provided rotatably between a first position and a second position different in an inclination angle of said movable separation inclined surface with respect to said sheet stacking surface; and operation means for switching said movable separation inclined surface between the first position and the second position.

2. A sheet feeding apparatus according to claim 1, wherein the angle between said sheet stacking surface and said movable separation inclined surface at the second position is selected to be larger than the angle between said sheet stacking surface and said movable separation inclined surface at the first position, and, by said operation means, said movable separation inclined surface is positioned at the first position when the sheets are stacked on said sheet stacking surface and is positioned at the second position when a sheet feeding operation is effected by said sheet feeding means.

3. A sheet feeding apparatus according to claim 2, wherein said sheet stacking surface is disposed obliquely at a predetermined angle with respect to a horizontal plane, and said sheet feeding means feeds out the sheet from a lower side of sheets stacked obliquely.

4. A sheet feeding apparatus according to claim 2, wherein said sheet stacking surface is disposed substantially horizontally.

5. A sheet feeding apparatus according to claim 2, wherein said movable separation inclined surface is formed on a movable inclined surface member rotatably supported, and said operation means includes an operation member for effecting operation, and a link mechanism for connecting said operation member to said movable inclined surface member.

6. A sheet feeding apparatus according to claim 2, further comprising shifting means for shifting said sheet feeding means in synchronous with a switching operation of said operation means in such a manner that said sheet feeding means are shifted in a direction away from said sheet stacking surface when said movable separation inclined surface is shifted to the first position and are urged against the stacked sheets when said movable separation inclined surface is shifted to the second position.

7. A sheet feeding apparatus according to claim 6, wherein said sheet feeding means is supported by a rotatable holder, and said shifting means rotates said holder by operation of an operation member provided in said operation means thereby to shift said sheet feeding means to a position where said sheet feeding means abut against the sheets or a position where said sheet feeding means is spaced apart from the sheets.

8. A sheet feeding apparatus according to claim 2, wherein said operation means include a sheet protection cover for protecting the sheets stacked on said sheet stacking surface, and, said movable separation inclined surface is located at the first position when said sheet protection cover is opened and is located at the second position when said sheet protection cover is closed.

9. A sheet feeding apparatus according to claim 2, further comprising sheet detecting means for detecting presence/absence of the sheet on said sheet stacking surface, and driving means for shifting said movable separation inclined surface to the first position when absence of sheet is detected by said sheet detecting means.

10. A sheet feeding apparatus according to claim 9, wherein said sheet detecting means includes a sensor lever rotated in accordance with the presence/absence of the sheet on said sheet stacking surface, and a detector turned ON/OFF by said sensor lever, and said sensor lever is disposed to be able to abut against leading ends of the sheets stacked on said sheet stacking surface and said detector is shifted in accordance with the shifting movement of said movable separation inclined surface.

11. A sheet feeding apparatus according to claim 10, wherein said movable separation inclined surface is formed on a movable inclined surface member rotatably supported and said detector is provided on said movable inclined surface member, and said sensor lever is supported rotatably around a rotation center same as a rotation center of said movable separation inclined surface.

12. A sheet feeding apparatus according to claim 2, wherein the angle between said movable separation inclined surface and said sheet stacking surface at the first position is a right angle, and the angle between said movable separation inclined surface and said sheet stacking surface at the second position is an obtuse angle.

13. A sheet feeding apparatus according to claim 1, wherein said sheet stacking surface and said movable separation inclined surface are provided on a sheet feeding cassette provided detachably attachable to a main body of said sheet feeding apparatus.

14. A sheet feeding apparatus according to claim 13, wherein the angle between said sheet stacking surface and said movable separation inclined surface in the second position is selected to be larger than the angle between said sheet stacking surface and said movable separation inclined surface in the first position, and said operation means are operated in such a manner than, when the sheet is contained in said sheet feeding cassette, said movable separation inclined surface is located at the first position, and, when said sheet feeding cassette is mounted to said main body of said sheet feeding apparatus and the sheet is fed by said sheet feeding means, said movable separation inclined surface is located at the second position.

15. A sheet feeding apparatus according to claim 14, wherein a grip for mounting and dismounting of said sheet feeding cassette is slidably provided on said sheet feeding cassette, and the position of said movable separation inclined surface is switched in accordance with slide position of said grip.

16. A sheet feeding apparatus according to claim 15, wherein a sliding direction of said grip is in parallel with a mounting/dismounting direction of said sheet feeding cassette, and, when said grip is shifted with respect to a body of said sheet feeding cassette in a mounting direction of said sheet feeding cassette, said movable separation inclined surface is shifted to the second position.

17. A sheet feeding apparatus according to claim 14, wherein said sheet feeding means includes shifting means for abutting said sheet feeding means against the upper surface of the sheets stacked in said sheet feeding cassette when said sheet feeding cassette is mounted to said main body of the apparatus and the sheets are fed out, and for spacing said sheet feeding means apart from the upper surface when said sheet feeding cassette is drawn out from said main body of the apparatus.

18. A sheet feeding apparatus according to claim 17, wherein said sheet feeding means is supported by a rotatable holder, and said shifting means includes a biasing member for biasing said holder toward a position where said sheet feeding means is spaced apart from the sheet, and releases a biasing operation of said biasing member upon mounting of said sheet feeding cassette thereby to shift said sheet feeding means to a position where said sheet feeding means abut against the sheet.

19. A sheet feeding apparatus according to claim 14, wherein a trailing end regulating plate for regulating trailing ends of the stacked sheets is rotatably provided on said sheet feeding cassette, and said movable separation inclined surface is connected to said trailing end regulating plate by a link mechanism in order to rotate said trailing end regulating plate in the same direction as the rotational direction of said movable separation inclined surface in accordance with the rotation of said movable separation inclined surface effected by said operation means.

20. An image forming apparatus comprising:

a sheet stacking surface for supporting sheets;

sheet feeding means for feeding out the sheets supported on said sheet stacking surface;

a movable separation inclined surface against which leading ends of the sheets supported on said sheet stacking surface abut and which is provided rotatably between a first position and a second position different in an inclination angle of said movable separation inclined surface with respect to said sheet stacking surface;

operation means for switching said movable separation inclined surface between the first position and the second position; and image forming means for forming an image on the sheet fed out by said sheet feeding means.

* * * * *

UNITED STATES PATENT AND TRADEMARK OFFICE

CERTIFICATE OF CORRECTION

PATENT NO. : 6,308,947 B1
DATED : October 30, 2001
INVENTOR(S) : Ryuichi Kojima et al.

It is certified that error appears in the above-identified patent and that said Letters Patent is hereby corrected as shown below:

Column 2,
Line 35, "not" should read -- not be --.
Line 48, "will" should read -- and will --.

Column 3,
Line 5, "the" should read -- from the --.
Line 20, "may" should read -- it may --.

Column 18,
Line 14, "include" should read -- includes --.
Line 18, "is." should read -- is --.

Signed and Sealed this

Twenty-sixth Day of March, 2002

*Attest:*

*Attesting Officer*

JAMES E. ROGAN
*Director of the United States Patent and Trademark Office*